US008571443B2

(12) United States Patent
Kobayashi

(10) Patent No.: US 8,571,443 B2
(45) Date of Patent: Oct. 29, 2013

(54) IMAGE FORMING APPARATUS AND UNIT HAVING MECHANISM FOR ALIGNING FIRST AND SECOND FIT PARTS

(75) Inventor: Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 315 days.

(21) Appl. No.: 13/004,074

(22) Filed: Jan. 11, 2011

(65) Prior Publication Data

US 2011/0176829 A1 Jul. 21, 2011

(30) Foreign Application Priority Data

Jan. 15, 2010 (JP) ..... 2010-007354

(51) Int. Cl.
*G03G 15/00* (2006.01)

(52) U.S. Cl.
USPC ..... 399/125

(58) Field of Classification Search
USPC ..... 399/110, 118, 124, 125; 347/138
See application file for complete search history.

(56) References Cited

U.S. PATENT DOCUMENTS

| | | | | |
|---|---|---|---|---|
| 5,978,626 | A * | 11/1999 | Nagamine et al. | 399/125 |
| 6,252,619 | B1 * | 6/2001 | Ueda et al. | 347/138 |
| 6,434,350 | B2 * | 8/2002 | Kikuchi et al. | 399/124 |
| 2009/0060562 | A1 * | 3/2009 | Itabashi | 399/98 |
| 2009/0087209 | A1 * | 4/2009 | Yamaguchi | 399/98 |
| 2009/0180798 | A1 * | 7/2009 | Itabashi | 399/111 |
| 2009/0252527 | A1 * | 10/2009 | Watanabe et al. | 399/111 |

FOREIGN PATENT DOCUMENTS

| | | |
|---|---|---|
| JP | 2003-112446 A | 4/2003 |
| JP | 2008-209862 A | 9/2008 |

* cited by examiner

*Primary Examiner* — Sandra Brase
(74) *Attorney, Agent, or Firm* — Marvin A. Motsenbocker; Mots Law, PLLC

(57) ABSTRACT

An image forming apparatus includes: an apparatus body formed with an opening; a cover capable of opening and closing the opening of the apparatus body; an image forming unit accommodated in the apparatus body; an exposure device provided at the cover; a first fit part provided at one of the image forming unit and the exposure device and having a first reference line; a second fit part provided at the other of the image forming unit and the exposure device and configured to be fit to the first fit part in a state where the cover is closed and having a second reference line; and a mechanism configured to, as the exposure device gets closer to the image forming unit upon closing the cover, make the first reference line of the first fit part closer to the second reference line of the second fit part by changing the inclination of the first fit part.

16 Claims, 22 Drawing Sheets

IMAGE FORMING APPARATUS AND UNIT HAVING MECHANISM FOR ALIGNING FIRST AND SECOND FIT PARTS

CROSS REFERENCE TO RELATED APPLICATIONS

This application claims priority based on 35 USC 119 from prior Japanese Patent Application No. 2010-007354 filed on Jan. 15, 2010, entitled "Image Forming Apparatus and Image Forming Unit", the entire contents of which are incorporated herein by reference.

BACKGROUND OF THE INVENTION

1. Field of the Invention

The invention relates to an image forming apparatus having an image forming apparatus body and a cover configured to open and close with respect to the image forming apparatus body.

2. Description of Related Art

There has been disclosed an electrophotographic image forming apparatus including a cover to open and close an upper opening of the apparatus body, and an exposure device attached to the inside of the cover. The image forming apparatus also includes an image forming unit having a photosensitive drum and accommodated in the apparatus body. In the image forming apparatus, when the cover is closed, the exposure device and the image forming unit are positioned at predetermined locations. Specifically, when the cover is closed, a hole (a fit part) formed at the exposure device and a post (a fit part) formed at the image forming unit are fit to each other so that the exposure device and the image forming unit are positioned to each other.

In an image forming apparatus disclosed in Japanese Patent Application Laid-Open No. 2008-209862, an exposure device is supported by the cover in such a manner that the exposure device is slightly moveable with respect to the cover. Upon closing or opening the cover with respect to the apparatus body, the above configuration prevents a post from getting stuck on a hole to prevent misalignment between the center of the post and the center of the hole, so as to prevent misalignment between the exposure device and the image forming unit.

SUMMARY OF THE INVENTION

However, a movement direction of the exposure device when the exposure device gets closer to the image forming unit upon closing the cover is different from the extending direction of the hole (a fit part) of the exposure device or the post (a fit part) of the image forming unit. This may hinder a smooth fit between the exposure device and the image forming unit.

An object of an aspect of the invention is to ensure a smooth fit between an exposure device and an image forming unit.

A first aspect of the invention is an image forming apparatus including: an apparatus body formed with an opening; a cover capable of opening and closing the opening of the apparatus body; an image forming unit accommodated in the apparatus body; an exposure device provided at the cover; a first fit part provided at one of the image forming unit and the exposure device and having a first reference line; a second fit part provided at the other of the image forming unit and the exposure device and configured to be fit to the first fit part in a state where the cover is closed and having a second reference line; and a mechanism configured to, as the exposure device approaches closer to the image forming unit upon closing the cover, make the first reference line of the first fit part closer to the second reference line of the second fit part by changing the inclination of the first fit part.

According to the first aspect, the exposure device and the image forming unit are fit to each other smoothly.

DETAILED DESCRIPTION OF EMBODIMENTS

Figure 1:
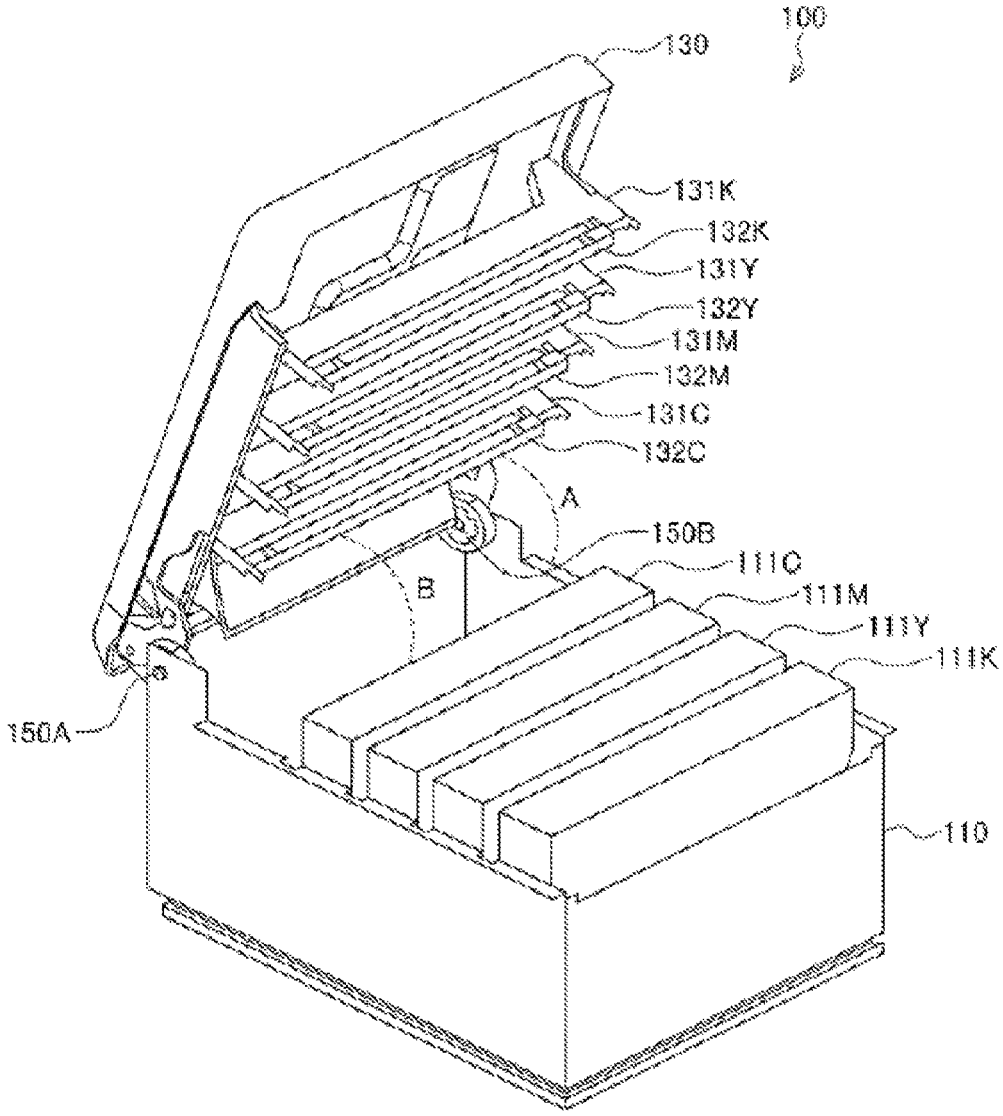
FIG. 1 is a view of a general configuration of an image forming apparatus according to a first embodiment.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a perspective view of the general configuration of image forming apparatus 100 according to the first embodiment. As shown in FIG. 1, image forming apparatus 100 includes body 110 of the image forming apparatus and cover 130.

Image forming units 111K, 111Y, 111M, and 111C are accommodated in apparatus body 110. Image forming unit 111K is configured to form a black developer image, image forming unit 111Y is configured to form a yellow developer image, image forming unit 111M is configured to form a magenta developer image, and image forming unit 111C is configured to form a cyan developer image. These image forming units 111K, 111Y, 111M, and 111C are referred to as image forming units 111 in the following description when they do not need to be distinguished from one another.

Cover 130 is equipped with exposure devices 131K, 131Y, 131M, and 131C. Exposure device 131K is used for black image forming unit 111K, exposure device 131Y is for yellow image forming unit 111Y, exposure device 131M is for magenta image forming unit 111M, and exposure device 131C is for cyan image forming unit 111C. These exposure devices 131K, 131Y, 131M, and 131C are referred to as exposure devices 131 in the following description when they do not need to be distinguished from one another.

Exposure heads 132K, 132Y, 132M, and 132C are attached to the lower ends of exposure devices 131K, 131Y, 131M, and 131C, which are ends of the exposure devices opposite from cover 130. Note that exposure head 132K is for black, exposure head 132Y is for yellow, exposure head 132M is for magenta, and exposure head 132C is for cyan. These exposure heads 132K, 132Y, 132M, and 132C are referred to as exposure heads 132 in the following description when they do not need to be distinguished from one another.

Cover 130 is attached to apparatus body 110 via axis members 150A and 150B, such that cover 130 rotates about the axis of axis members 150A and 150B in a range between a first position where cover 130 covers the upper opening of apparatus body 110 and a second position where cover 130 opens the upper opening of apparatus body 110. As cover 130 rotates about the axis of axis members 150A and 150B, cover 130 moves along circular arc path A and exposure device 131, which is attached to cover 130, moves along circular arc path B corresponding to the movement (circular arc path A) of cover 130.

Figure 2:
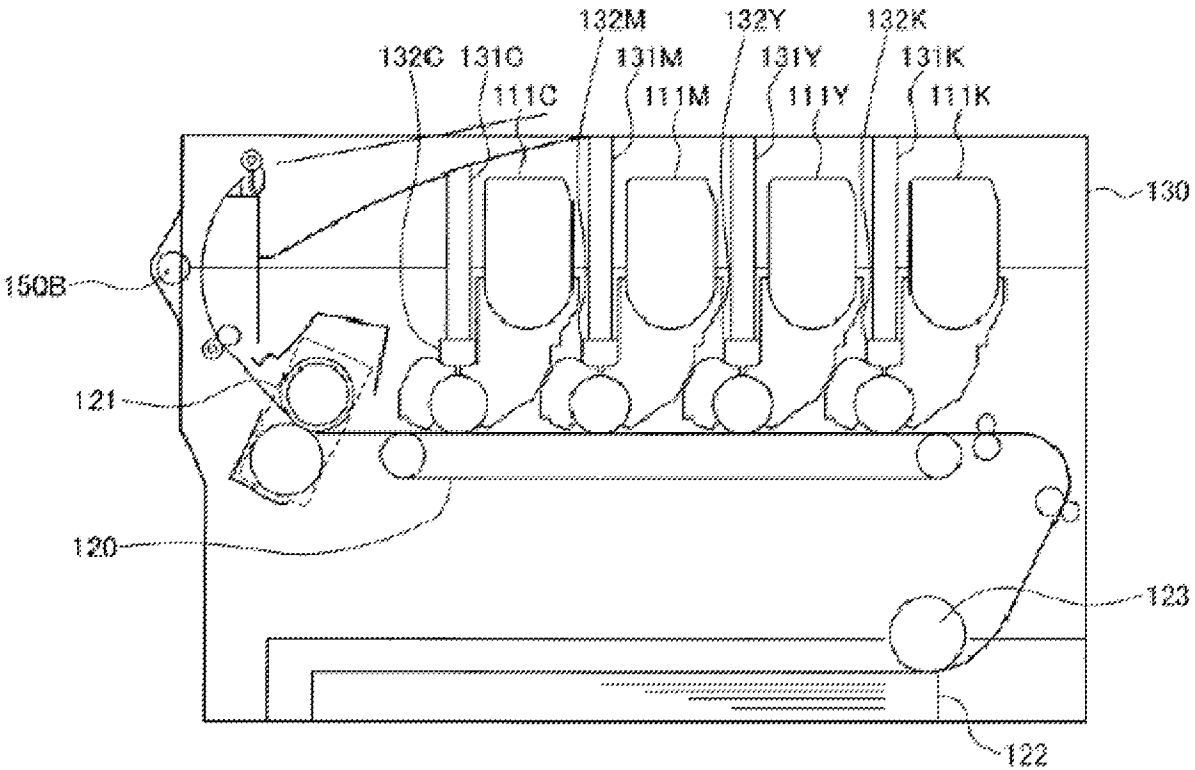
FIG. 2 is a vertical sectional view of the image forming apparatus according to the first embodiment.

FIG. 2 is a vertical sectional view of image forming apparatus 100. As shown in FIG. 2, accommodated in body 110 of image forming apparatus 100 are: image forming unit 111 configured to form a developer image on photosensitive drum 112 serving as an image carrier; transfer belt unit 120 configured to transfer the developer image from the image carrier to a recording medium such as a sheet of paper; fixing device 121 configured to fix the developer image to the recording medium that is transferred to the recording medium; sheet cassette 122 in which the recording media are to be accommodated; and sheet feeding device 123 configured to feed the recording medium from sheet cassette 122 to transfer belt unit 120. Each exposure device 131 attached to cover 130 is configured to form an electrostatic image on photosensitive drum 112 by exposing light onto photosensitive drum 112.

Figure 3:
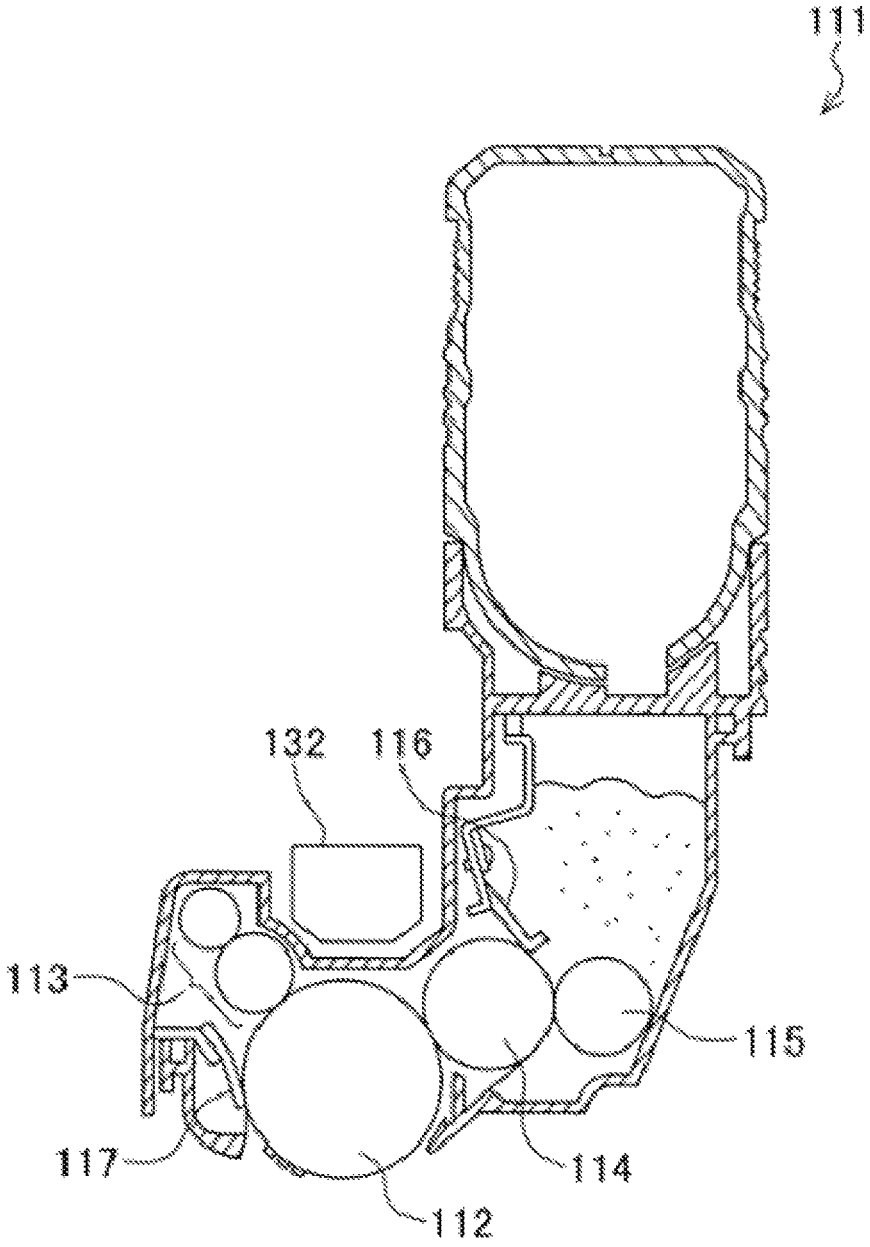
FIG. 3 is a vertical sectional view illustrating an image forming unit and an exposure head according to the first embodiment.

FIG. 3 is a vertical sectional view illustrating image forming unit 111 and exposure head 132. As shown in FIG. 3, image forming unit 111 includes: photosensitive drum 112 serving as the image carrier; charging device 113 configured to charge photosensitive drum 112; development roller 114 configured to form the developer image on photosensitive drum 112 by developing the electrostatic latent image on photosensitive drum 112 with the developer; supplying roller 115 configured to supply the developer to development roller 114; development blade 116 being in press-contact with development roller 114 thereby forming a layer of the developer on development roller 114; and cleaning unit 117 configured to remove the developer remaining on photosensitive drum 112. Note that a pair of side frames (not shown in FIG. 3) are provided at longitudinal ends of photosensitive drum 112 in image forming unit 111.

Exposure head 132 is configured to form an electrostatic latent image on photosensitive drum 112 by exposing photosensitive drum 112 to light according to print data. If exposure head 132 is out of alignment with respect to photosensitive drum 112, the electrostatic latent image, which is formed on photosensitive drum 112 by the light exposed from exposure head 132, goes out of focus.

To prevent the out of focus, it may be proposed that the exposure device and the image forming unit are formed with fit parts which are fit to each other. However, upon closing and opening the cover, the exposure device, which is attached to the cover, moves along circular arc path A about the rotational axis of the cover. Thus, as the cover is closed, the orientation (the inclination) of the fit part of the exposure device gradually changes with respect to the orientation (the inclination) of the fit part of the image forming unit. Accordingly, if the orientation of the fit part of the exposure device and the orientation of the fit part of the image forming unit are misaligned to each other when the fit part of the exposure device and the fit part of the image forming device start to fit to each other, the fit part of the exposure device gets stuck on the fit part of the image forming unit, preventing the smooth fit.

To solve such a problem, the first embodiment includes a mechanism (adjustment unit 119B and tab 133B-a) to change the orientation (the inclination) of the fit part (post 119B-b) of image forming unit 111 in accordance with the change of the orientation (the inclination) of the fit part (positioning hole 132B-a) of exposure device 131 as cover 130 is closed, to prevent the fit part (positioning hole 132B-a) of exposure device 131 from getting stuck on the fit part (post 119B-b) of image forming unit 111, to provide the smooth fit. The detail will be described below.

Figure 4:
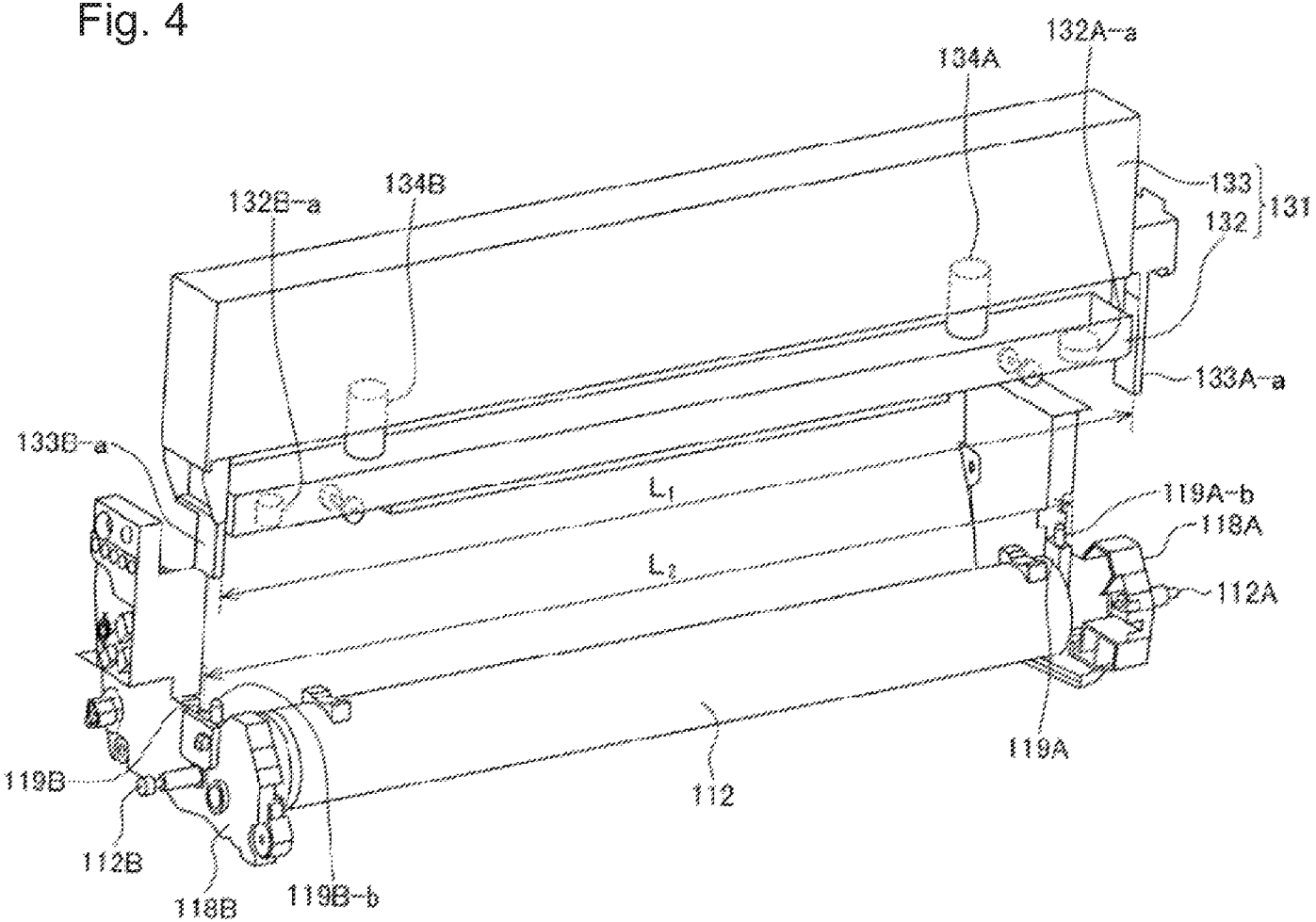
FIG. 4 is a diagrammatic view illustrating an exposure device and a photosensitive drum and a side frame according to the first embodiment.

FIG. 4 is a diagrammatic view illustrating exposure device 131, photosensitive drum 112, and side frames 118A and 118B.

Side frames 118A and 118B are provided at longitudinal ends of photosensitive drum 112, respectively, such that side frames 118A and 118B support photosensitive drum 112 to be rotatable. For example, shafts 112A and 112B of photosensitive drum 112, which rotatably support photosensitive drum 112, are respectively inserted through holes (not shown) of side frames 118A and 118B, which are formed at positions in side frames 118A and 118B corresponding to shafts 112A and 112B, such that photosensitive drum 112 is rotatable with respect to side frames 118A and 118B in this embodiment.

Side frames 118A and 118B are provided with adjustment units 119A and 119B, respectively. Adjustment units 119A and 119B are formed with posts 119A-b and 119B-b, serving as positioning projections or fit parts, projecting toward exposure device 131 from adjustment units 119A and 119B. Note that the detail about adjustment units 119A and 119B will be described later with reference to FIG. 5.

Exposure device 131 includes exposure head 132 and exposure head holder 133 which holds exposure head 132. Note that exposure head 132 is a LED head, which uses LEDs as a light source in this embodiment; however, the invention is not limited to this.

A surface of exposure head 132 that is opposed to side frames 118A and 118B, has positioning holes 132A-a and 132B-a at positions corresponding to adjustment units 119A and 119B of side frames 118A and 118B. Positioning holes 132A-a and 132B-a have a size and shape such that posts 119A-b and 119B-b of adjustment units 119A and 119B fit into positioning holes 132A-a and 132B-a, respectively.

In this embodiment, positioning hole 132A-a into which post 119A-b is to be fit is an elongated, bottomed hole extending along the longitudinal direction of exposure head 132. That is, positioning hole 132A-a has an inner space whose inner diameter in the longitudinal direction of exposure head 132 is greater than the inner diameter in the widthwise direction of exposure head 132. On the other hand, positioning hole 132B-a, into which post 119B-b is to be fit, is a circular, bottomed hole. That is, positioning hole 132B-a has an inner space whose inner diameter in the longitudinal direction of exposure head 132 is the same as the inner diameter in the widthwise direction of exposure head 132. Note that, like positioning hole 132B-a, positioning hole 132A-a may be formed in such a manner that the inner diameter in the longitudinal direction of exposure head 132 is the same as the inner diameter in the widthwise direction of exposure head 132, in a modification example.

One end (the upper end) of exposure head holder 133 in the thickness direction is fixed on the inside surface of cover 130, which faces the inside of apparatus body 110. Exposure head 132 is configured to be detachably attached to the other end (the lower end) of exposure head holder 133 in the thickness direction, which is not fixed on cover 130. Exposure head holder 133 is provided with elastic members 134A and 134B, which bias exposure head 132 in the direction away from cover 130 (the direction toward photosensitive drum 112) when exposure head 132 has been attached to exposure head holder 133.

Provided at axial ends of exposure head holder 133 are tabs 133B-a and 133A-a, serving as contact parts, extending downward from exposure head holder 133. Distance L1 between the inside of tab 133B-a and the inside of tab 133A-a is greater than distance L2 between the outside of side frame 118A and the outside of side frame 118B. As the upper opening of apparatus body 110 is closed with cover 130, tab 133A-a, 133B-a come in contact with second inclined surface 119B-i of intervening member 119B-d (to be described later).

Note that tabs 133A-a and 133B-a have the shape and the size such that when tips of posts 119A-b and 119B-b of adjustment units 119A and 119B enter into positioning holes 132A-a and 132B-a, tips of tabs 133A-a and 133B-a come in contact with second inclined surface 119B-i of intervening member 119B-d.

Figure 5:
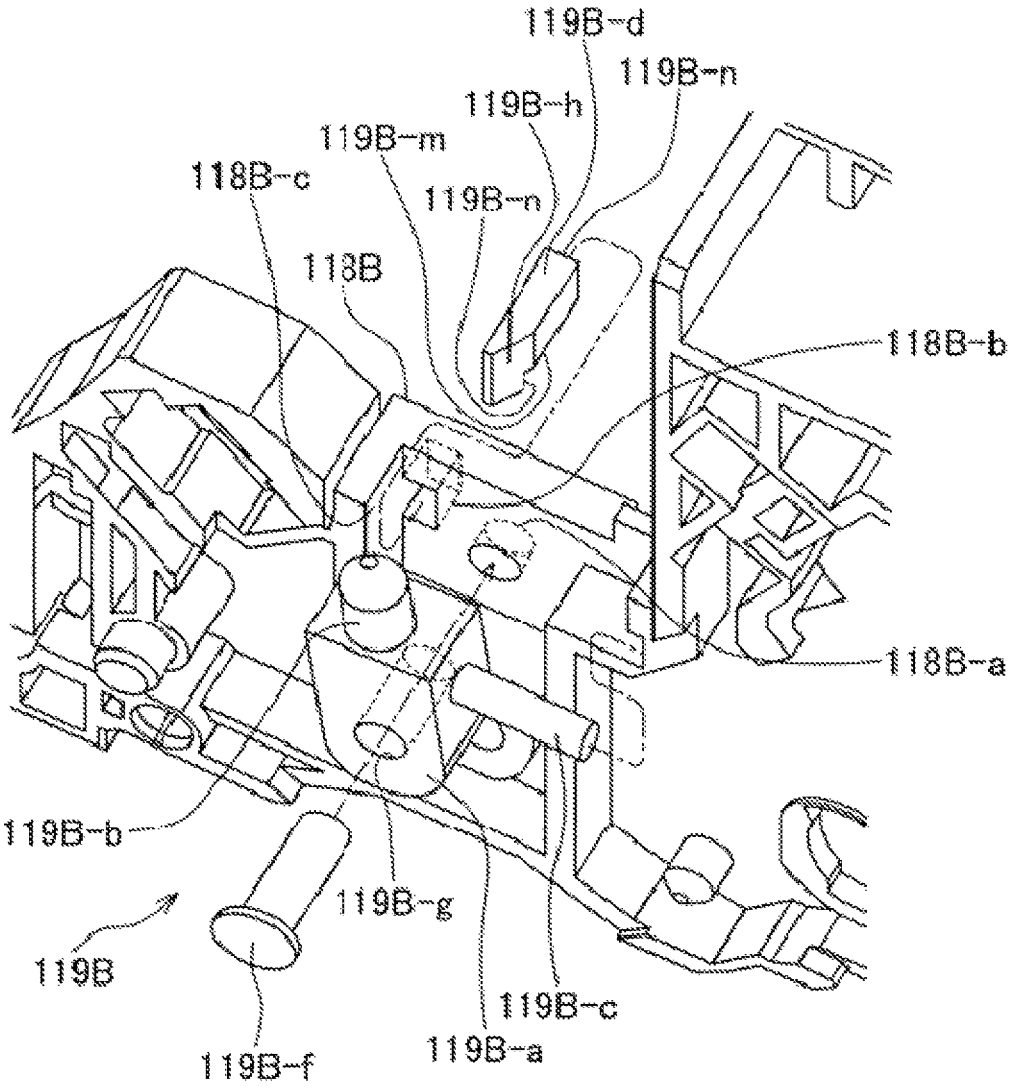
FIG. 5 is an exploded perspective view illustrating an adjustment unit according to the first embodiment.

FIG. 5 is an exploded perspective view illustrating adjustment unit 119B. As shown in FIG. 5, adjustment unit 119B includes base member 119B-a, post 119B-b, bias member 119B-c, and intervening member 119B-d.

Adjustment unit base member 119B-a is rotatably supported by side frame 118B to be rotatable about its rotational axis parallel to the axis of axis members 150A and 150B of cover 130.

Specifically, the inner lateral surface of side frame 118B, which is a surface of side frame 118B where photosensitive drum 112 is attached, is formed with bearing hole 118B-a (a rotation support hole) whose axis is parallel to the rotational axis of cover 130. Adjustment unit base member 119B-a is formed with through hole 119B-g. Adjustment unit base member 119B-a is disposed on the inner lateral side of side frame 118B in such a manner that through hole 119B-g and bearing hole 118B-a are aligned with each other. Axis member 119B-f is inserted, from the inner lateral side toward the outer lateral side of side frame 118B, through a through hole 119B-g of adjustment unit base member 119B-a and the tip of axis member 119B-f is inserted in bearing hole 118B-a of side frame 118B. With this structure, adjustment unit base member 119B-a is rotatable about the axis of axis member 119B-f.

Post 119B-b (serving as a fit part) projects upward (in a direction toward cover 130) from adjustment unit base member 119B-a. The longitudinal direction of post 119B-b is designed orthogonal to the axis of adjustment unit base member 119B-a. Further, the shape and size of post 119B-b is designed in such a manner that post 119B-b is able to be fit into positioning hole 132B-a (serving as the other fit part) formed at exposure head 132. The end portion of post 119B-b is formed in a tapered shape whose cross-section gradually decreases from a certain point toward the end of post 119B-b, to prevent the end portion of post 119B-b from being caught by the peripheries of positioning hole 132B-a and positioning hole 132B-a when post 119B-b is being inserted into positioning hole 132B-a.

Bias member 119B-c is configured to bias the upper portion of adjustment unit base member 119B-a toward axis members 150A and 150B of cover 130. For example, bias member 119B-c of this embodiment is made of, at least in part, an elastic member such as rubber, a spring, or the like. Bias member 119B-c is in contact with the upper portion of adjustment unit base member 119B-a (a portion of adjustment unit base member 119B-a higher than the axis of through hole 119B-g, that is, a portion of adjustment unit base member 119B-a closer to post 119B-b than the axis of through hole 119B-g). Bias member 119B-c is disposed at the opposite side of axis members 150A and 150B of cover 130 across adjustment unit base member 119B-a and is sandwiched between adjustment unit base member 119B-a and side frame 118B. Therefore, bias member 119B-c biases the upper portion of adjustment unit base member 119B-a toward axis members 150A and 150B of cover 130.

Intervening member 119B-d is configured to push back the upper portion of adjustment unit base member 119B-a, which is the portion of adjustment unit base member 119B-a higher than the axis of through hole 119B-g, in the direction away from axis members 150A and 150B of cover 130 against the bias force of bias member 119B-c, as exposure device 131 moves closer to side frame 118B upon closure of cover 130.

Figure 6A:
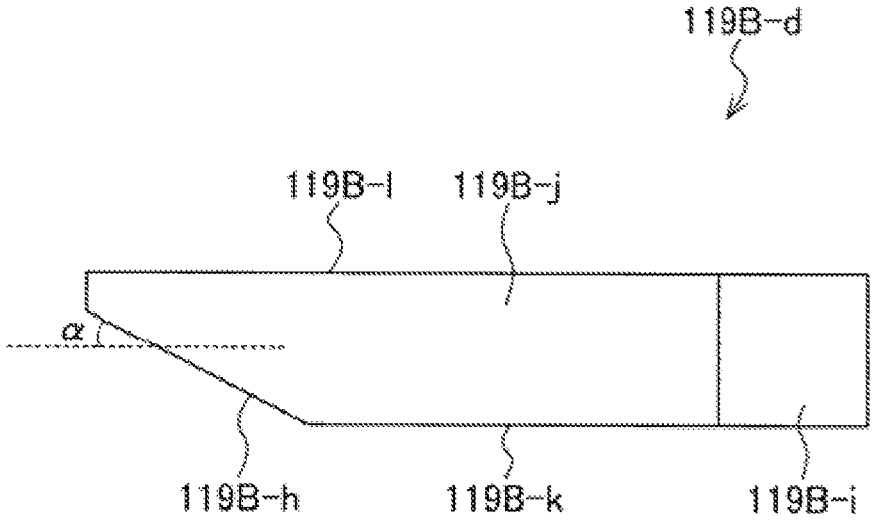
FIG. 6A is a top view of and FIG. 6B is a side view of an intervening member according to the first embodiment.
Figure 6B:
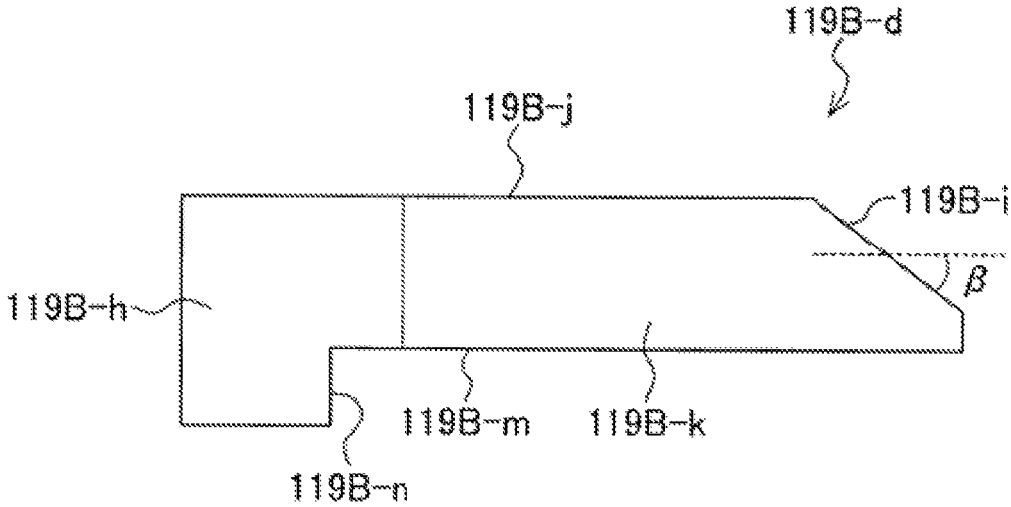

FIGS. 6A and 6B are diagrammatic views of intervening member 119B-d. In the embodiment, intervening member 119B-d is a column shaped member extending in a specified direction. Intervening member 119B-d has first inclined surface 119B-h at a first longitudinal end portion as shown in FIG. 6A and second inclined surface 119B-i at a second longitudinal end portion as shown in FIG. 6B.

As shown in FIG. 6A, side surface 119B-k of intervening member 119B-d has first inclined surface 119B-h at the first longitudinal end portion such that the thickness of the first longitudinal end portion of intervening member 119B-d gradually increases from the first longitudinal end toward the second longitudinal end. As shown in FIG. 5, intervening member 119B-d is inserted in slide guide hole 118B-b (to be described later) of side frame 118B such that upper surface 119B-j of intervening member 119B-d faces upward and first inclined surface 119B-h faces toward adjustment unit base member 119B-a.

As shown in FIG. 6B, upper surface 119B-j of intervening member 119B-d has second inclined surface 119B-i at the second longitudinal end portion such that the thickness of the second longitudinal end portion of intervening member 119B-d gradually increases from the second longitudinal end toward the first longitudinal end. Side surface 119B-1 of intervening member 119B-d, which is the opposite side of side surface 119B-k having first inclined surface 119B-h, is flat.

As shown in FIG. 6B, lower surface 119B-m of intervening member 119B-d has step 119B-n at the first longitudinal end portion, such that the thickness of the first longitudinal end portion having first inclined surface 119B-h is greater than that of the second longitudinal end portion having second inclined surface 119B-i. Note that the location of step 119B-n is designed in such a manner that the first longitudinal end of intervening member 119B-d having first inclined surface 119B-h is inserted between adjustment unit base member 119B-a and opposing surface 118B-c (to be described later) of side frame 118B at a predetermined depth, when step 119B-n of intervening member 119B-d is stopped by the edge of slide guide hole 118B-b after intervening member 119B-d is inserted into slide guide hole 118B-b of side frame 118B from the second longitudinal end portion of intervening member 119B-d, which has second inclined surface 119B-i.

The angle $\alpha$ of first inclined surface 119B-h and the angle $\beta$ of second inclined surface 119B-i with respect to the longitudinal direction of intervening member 119B-d are designed such that, when post 119B-b is being inserted into positioning hole 132B-a of exposure head 132 upon the closure of cover 130, intervening member 119B-d changes the orientation (inclination) of adjustment unit base member 119B-a so as to correspond reference line E of post 119B-b, which extends in its extending direction (an extending direction of the tip of post 119B-b) and passes through the tip of post 119B-b (see FIGS. 9A to 9D), to reference line F of positioning hole 132B-a, which extends in its opening direction (an extending direction of the opening end of positioning hole 132B-a) and passes through the opening end of positioning hole 132B-a (see FIGS. 9A to 9D). Note that, although reference line E of post 119B-b is the axis of post 119B-b and reference line F of positioning hole 132B-a is the axis of positioning hole 132B-a in this embodiment, the invention is not limited to this, but reference line E of post 119B-b and reference line F of positioning hole 132B-a are homologized to each other, when exposure head 132 and image forming unit 111 (photosensitive drum 112) are aligned to each other.

Referring back to FIG. 5, slide guide hole 118B-b, formed in side frame 118B, is provided at a position higher than the axis of bearing hole 118B-a and closer to bearing hole 118B-a than axis members 150A and 150B of cover 130. The axis of slide guide hole 118B-b is parallel to the rotational axis of cover 130. The size and shape of slide guide hole 118B-b is designed such that a portion of intervening member 119B-d between step 119B-n and the second longitudinal end is slidable in slide guide hole 118B-b in the longitudinal direction of intervening member 119B-d, while the size and shape of the first longitudinal end portion of intervening member 119B-d is designed such that a portion of intervening member 119B-d between step 119B-n and the first longitudinal end is not able to enter slide guide hole 118B-b.

Further, the side frame 118 has opposing surface 118B-c facing adjustment unit base member 119B-a. Opposing surface 118B-c is continuously formed with and flush with one of internal surfaces of slide guide hole 118B-b at the opposite side of bearing hole 118B-a across slide guide hole 118B-c. Since side surface 119B-1 of intervening member 119B-d is in contact with opposing surface 118B-c in the state where intervening member 119B-d is in slide guide hole 118B-b, intervening member 119B-d, which receives the biasing force of bias member 119B-c, is stopped by opposing surface 118B-c and does not move further in the direction toward the biasing force of bias member 119B-c.

Note that side frames 118A and 118B are symmetrically-arranged and adjustment units 119B and 119A are symmetrically-arranged with respect to a plane orthogonal to the rotational axis of photosensitive drum 112, respectively.

Figure 7A:
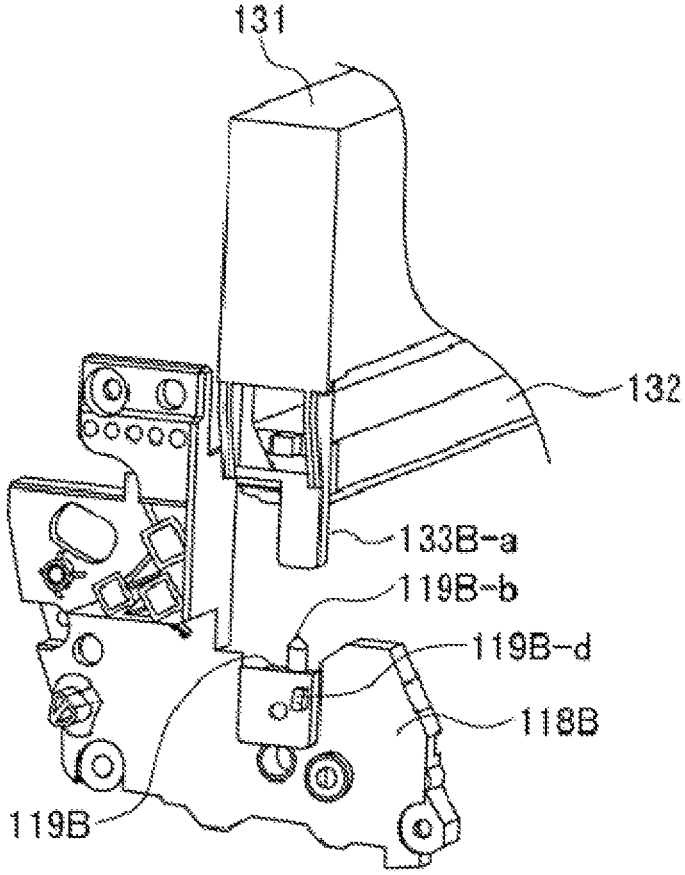
FIGS. 7A to 7C are diagrammatic views illustrating the orientation (inclination) of a post when the exposure device and the side frame are apart from each other according to the first embodiment.
Figure 7C:
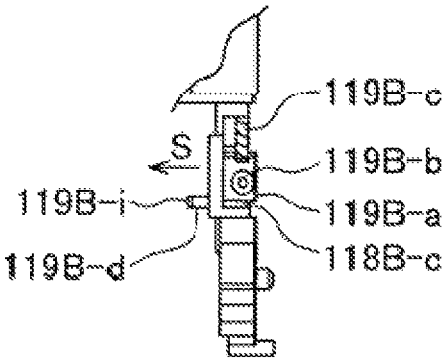
Figure 7B:
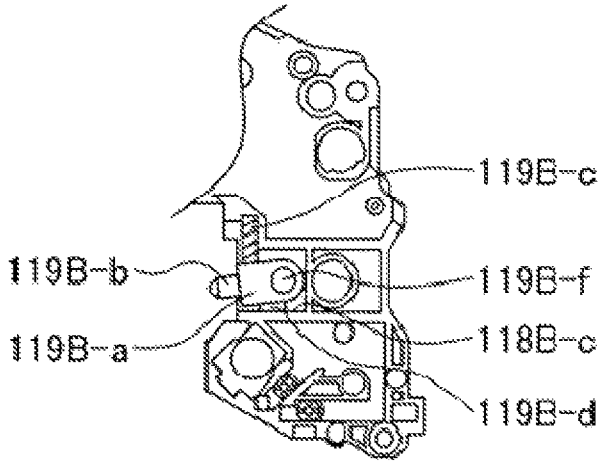

As described above, this embodiment has tabs 133A-a and 133B-a and adjustment units 119A and 119B. Accordingly, in the state where exposure device 131 is away from side frame 118B and tab 133B-a is thus not in contact with intervening member 119B-d of adjustment unit 119B as shown in FIG. 7A, the upper portion of adjustment unit base member 119B-a, which is the portion of adjustment unit base member 119B-a closer to post 119B-b than the rotational axis of axis member 119B-f, is biased away from bias member 119B-c toward axis members 150A and 150B of cover 130 by the biasing force of bias member 119B-c, as shown in FIG. 7B. Thus, intervening member 119B-d receives the biasing force of bias member 119B-c via adjustment unit base member 119B-a. Thus, the biasing force of bias member 119B-c is converted into a force in the outer lateral direction S of side frame 118B by first inclined surface 119B-h of intervening member 119B-d, which makes intervening member 119B-d moving in outer lateral direction S of side frame 118B, in the state where tab 113B-a is not in contact with intervening member 119B-d as shown in FIG. 7C. Such movement of intervening member 119B-d is stopped by step 119B-n when step 119B-n comes in contact with the edge of slide guide hole 118B-b. At the moment, as shown in FIG. 7C, second inclined surface 119B-i of intervening member 119B-d is exposed outside of side frame 118B.

Figure 8A:
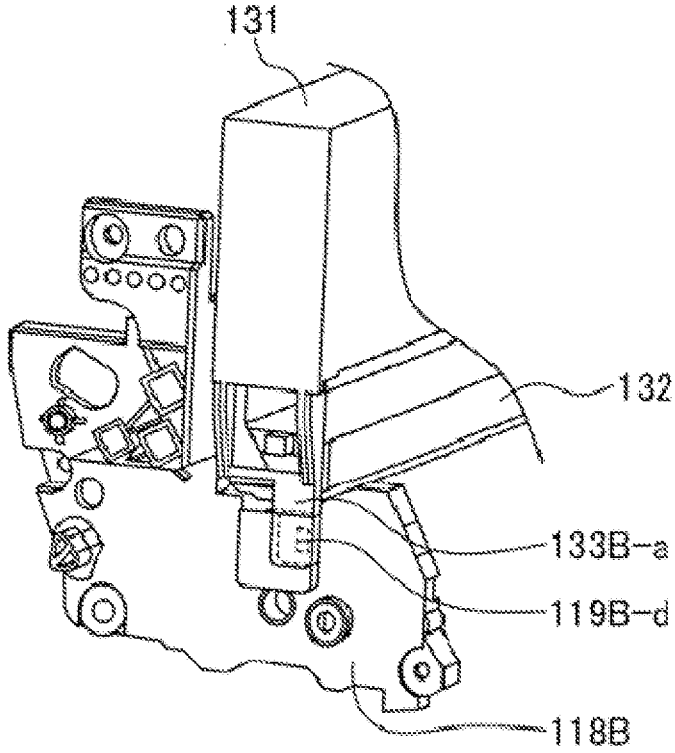
FIGS. 8A to 8C are diagrammatic views illustrating the orientation (inclination) of the post when the exposure device and the side frame are close to each other according to the first embodiment.

On the other hand, as show in FIG. 8A, in the state where side frame 118B of exposure device 131 is close to exposure head 132 and post 119B-b is thus fit in positioning hole 132B-a of exposure head 132, tab 133B-a is at a position where tab 133B-a covers intervening member 119B-d.

Figure 8C:
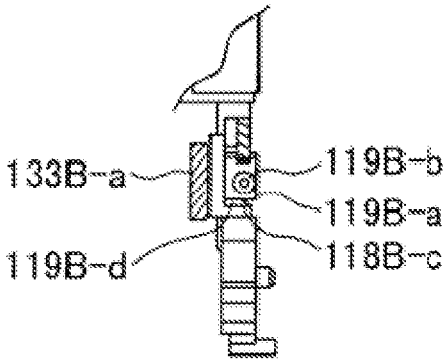
Figure 8B:
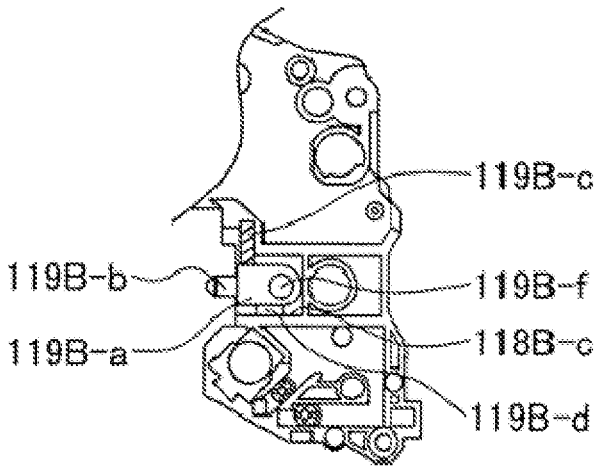

When exposure device 131 moves closer to side frame 118B by closing cover 130 (see FIG. 1), tab 133B-a of exposure device 131 comes in contact with second inclined surface 119B-i (see FIG. 6B) of intervening member 119B-d. The force of exposure device 131 moving closer to side frame 118B is applied to second inclined surface 119B-i (see FIG. 6B) of intervening member 119B-d. At the time, second inclined surface 119B-i (see FIG. 6) of intervening member 119B-d, which is located in slide guide hole 118B-b and thus is not able to move in the direction along which exposure device 131 moves, converts the applied force into a force in the inner lateral direction of side frame 118B. Thus, intervening member 119B-d moves inward of side frame 118B. When intervening member 119B-d moves inward of side frame 118B, the maximum thickness of the first longitudinal end portion of intervening member 119B-d sandwiched between opposing surface 118B-c and adjustment unit base member 119B-a increases gradually due to first inclined surface 119B-h (see FIG. 6A). This moves the upper portion of adjustment unit base member 119B-a, which is the portion of adjustment unit base member 119B-a closer to post 119B-b than the rotational axis of axis member 119B-f, in the direction toward bias member 119B-c (in the direction away from axis members 150A and 150B of cover 130) against the biasing force of bias member 119B-c, as shown in FIG. 8B. Thus, as shown in FIG. 8C, intervening member 119B-d is located on an inner side of side frame 118B relative to tab 133B-a.

As shown in FIGS. 7 and 8, in this embodiment, due to the movement of exposure device 131 upon closing and opening cover 130 (see FIG. 1), posts 119A-b and 119B-b of adjustment units 119A and 119B move between a first position closer to axis members 150A and 150B of cover 130 and a second position away from axis members 150A and 150B of cover 130.

According to the configuration of the first embodiment as described above, as shown in FIG. 9A, reference line E of post 119B-b is inclined toward axis members 150A and 150B of cover 130 (see FIG. 1) with biasing force of bias member 119B-c (see FIG. 5), in the state where exposure head 132 is not in contact with intervening member 119B-d of adjustment unit 119B.

Figures 9A, 9B, 9C, 9D:
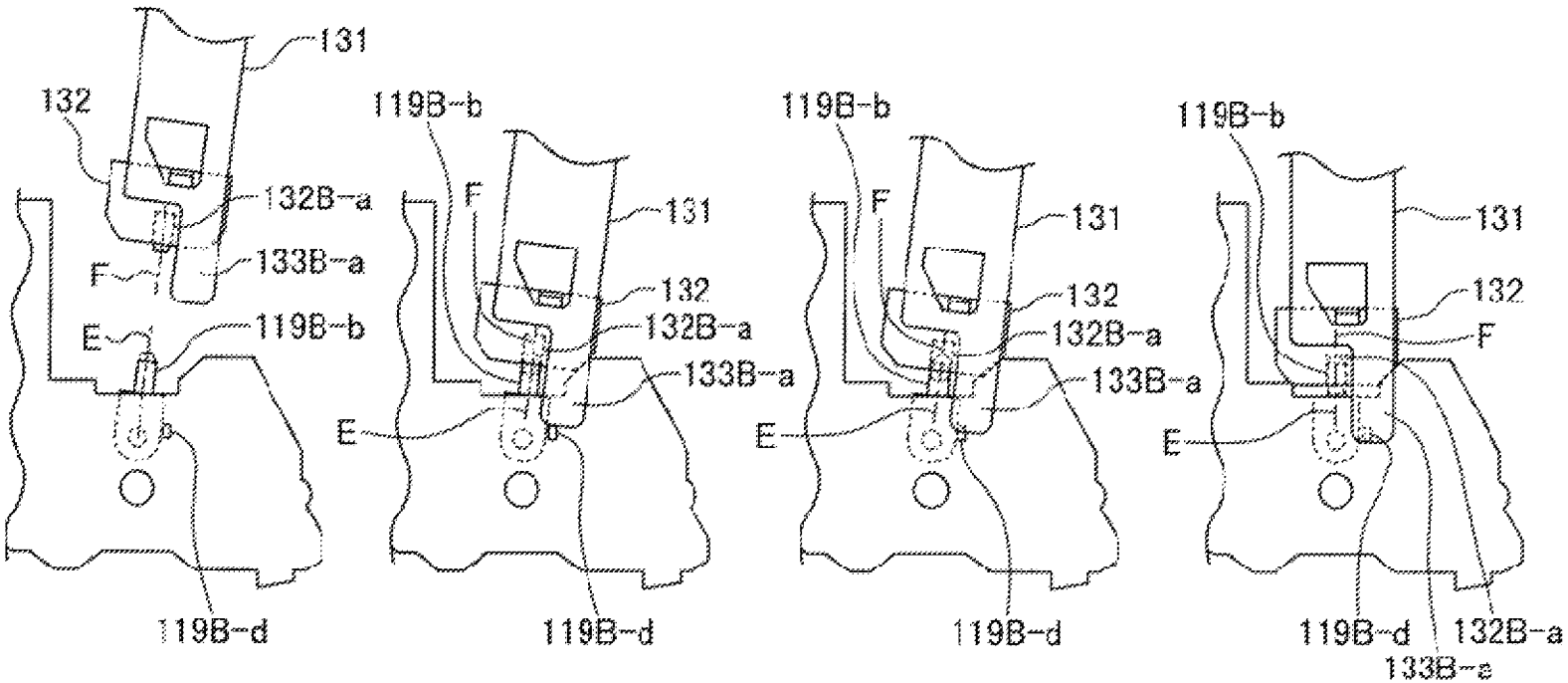
FIGS. 9A to 9D are diagrammatic views illustrating change of the orientation (inclination) of the post with respect to a positioning hole according to the first embodiment.

As shown in FIG. 9B, when tab 133B-a starts contacting with second inclined surface 119B-i (see FIG. 6B) of intervening member 119B-d upon further closing the cover 130 from the state of FIG. 9A, the inclination of reference line E of post 119B-b is homologized to the inclination of reference line F of positioning hole 132B-a. At that time, an extension of reference line E of post 119B-b and an extension of reference line F of positioning hole 132B-a are aligned to each other.

As shown in FIG. 9C, when cover 130 (see FIG. 1) is further closed from the position shown in FIG. 9B, tab 133B-a pushes second inclined surface 119B-i (see FIG. 6B) of intervening member 119B-d, moving intervening member 119B-d inward of side frame 118B. First inclined surface 119B-h of intervening member 119B-d thus pushes adjustment unit base member 119B-a (see FIG. 5) toward bias member 119B-c against the biasing force of bias member 119B-c (see FIG. 5). Accordingly, the angle of the inclination of reference line E of post 119B-b with respect to the vertical direction becomes smaller such that reference line E of post 119B-b rotates away from axis members 150A and 150B (see FIG. 1) of cover 130 toward bias member 119B-c (see FIG. 5). Accordingly, the inclination of reference line E of post 119B-b is changed in accordance with the change of the inclination of reference line F of positioning hole 132B-a of exposure head 132, which rotates about the rotational axis of axis members 150A and 150B (see FIG. 1) of cover 130, thereby aligning such reference lines E and F (the extensions of reference lines E and F) to each other.

Further, as shown in FIG. 9D, when tab 133B-a reaches a position where tab 133B-a covers the outer lateral surface of intervening member 119B-d by further closing cover 130 (see FIG. 1) from the position of FIG. 9C, intervening member 119B-d moves further inward of side frame 118B. Thus, reference line E of post 119B-b turns further away from axis members 150A and 150B (see FIG. 1) of cover 130 and then is oriented in the vertical direction in FIG. 9. Accordingly, the inclination of reference line E of post 119B-b is changed in accordance with the change of the inclination of reference line F of positioning hole 132B-a of exposure head 132, which rotates about the rotational axis of axis members 150A and 150B (see FIG. 1) of cover 130, thereby aligning such reference lines E and F (the extensions of reference lines E and F) to each other. Note that the definition that "reference lines E and F are aligned to each other" in this embodiment means that a shifted amount between reference lines E and F is less than a predetermined threshold. Such threshold is a value that prevents an out of focus due to variation of distance between exposure head 132 and photosensitive drum 112 where photosensitive drum 112 and exposure head 132 are aligned to each other.

According to the first embodiment as described above, the inclinations of the reference lines of posts 119A-b and 119B-b formed at side frames 118A and 118B are changed in accordance with the change of the inclinations of the reference lines of positioning holes 132A-a and 132B-a formed at exposure device 131 upon the movement of exposure device 13 along the circular arc path. Therefore, posts 119A-b and 119B-b are able to be inserted into positioning holes 132A-a and 132B-a without posts 119A-b and 119B-b getting stuck on the edges of positioning holes 132A-a and 132B-a. Since the first embodiment has such a mechanism including tabs 133A-a and 133B-a and adjustment units 119A and 119B, exposure device 131 and photosensitive drum 112, which are aligned to each other by inserting posts 119A-b and 119B-b into positioning holes 132A-a and 132B-a, are reliably positioned such that the distance between exposure device 131 and photosensitive drum 112 is the predetermined distance. This prevents variation of the distance between exposure device 131 and photosensitive drum 112, thus preventing out of focus.

Figure 10:
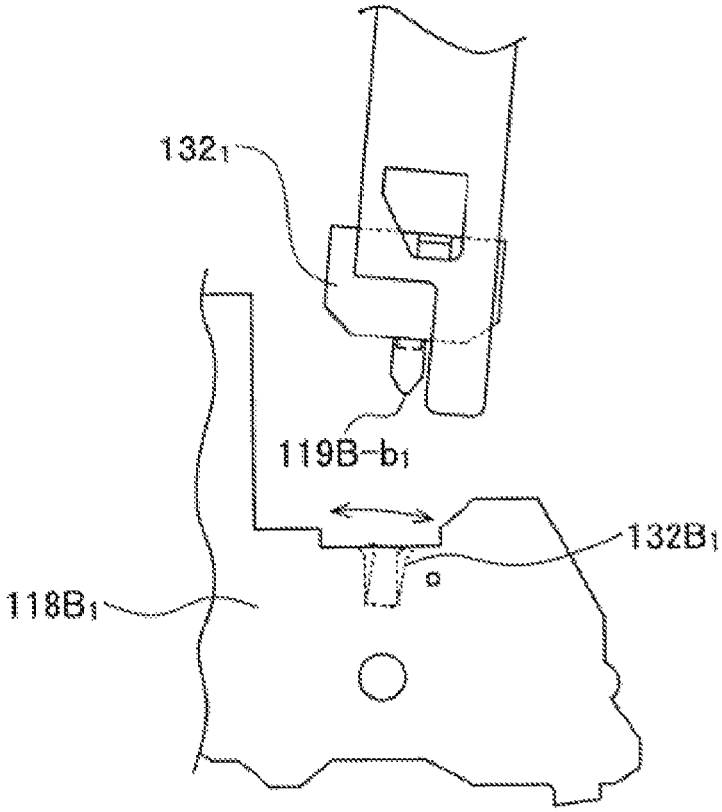
FIG. 10 is a side view of a modification of the first embodiment.

Although positioning holes 132A-a and 132B-a are formed at exposure head 132 and posts 119A-b and 119B-b are formed at side frames 118A and 118B in the first embodiment, the invention is not limited to this. For example, as shown in FIG. 10 (a first modification of the first embodiment), post 119B-$b_1$ may be formed at exposure head 132$_1$ and positioning hole 132B-$a_1$ may be formed at side frame 118B$_1$.

Although the inclinations (the orientations) of posts 119A-b and 119B-b are changed by rotating adjustment units 119A and 119B with respect to side frames 118A and 118B in the first embodiment, the invention is not limited to this. For example, as shown in FIG. 11 (a second modification of the first embodiment), adjustment unit 119B$_2$ may be formed at exposure head 132$_2$ and tab 133B-$a_2$ and positioning hole 132B-$a_2$ may be formed at side frame 118B$_2$.

Figure 11:
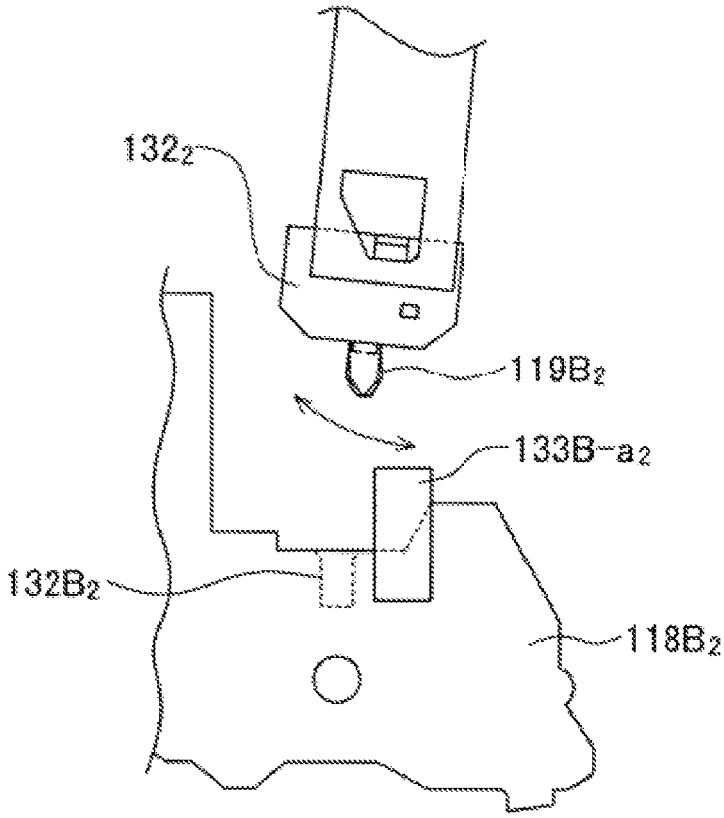
FIG. 11 is a side view of a modification of the first embodiment.
Figure 12:
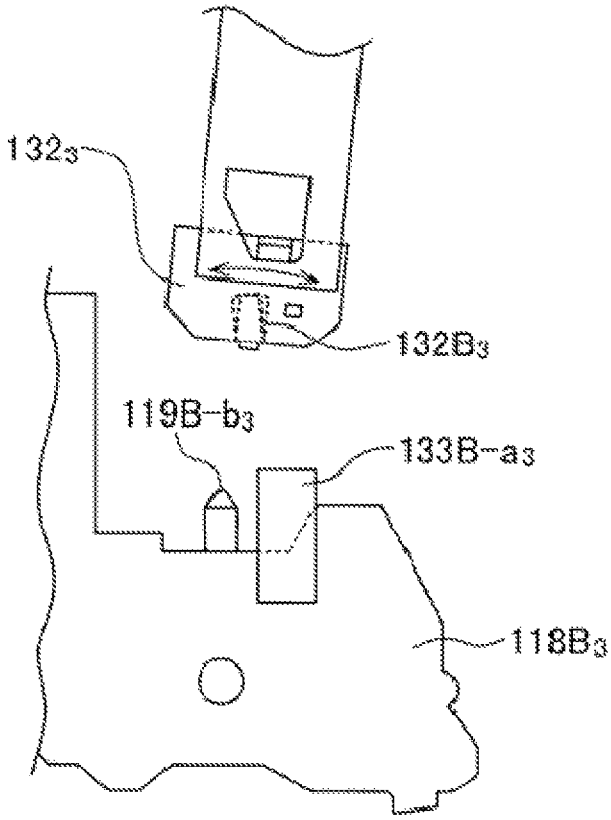
FIG. 12 is a side view of a modification of the first embodiment.

Further, adjustment unit 119B$_2$ and positioning hole 132B-$a_2$ shown in FIG. 11 may be interchanged with each other such that positioning hole 132B-$a_3$ is formed at exposure head 132$a_3$ and post 119B-$b_3$ is formed at side frame 118B$_3$ as shown in FIG. 12 (a third modification of the first embodiment).

Second Embodiment

Figure 13:
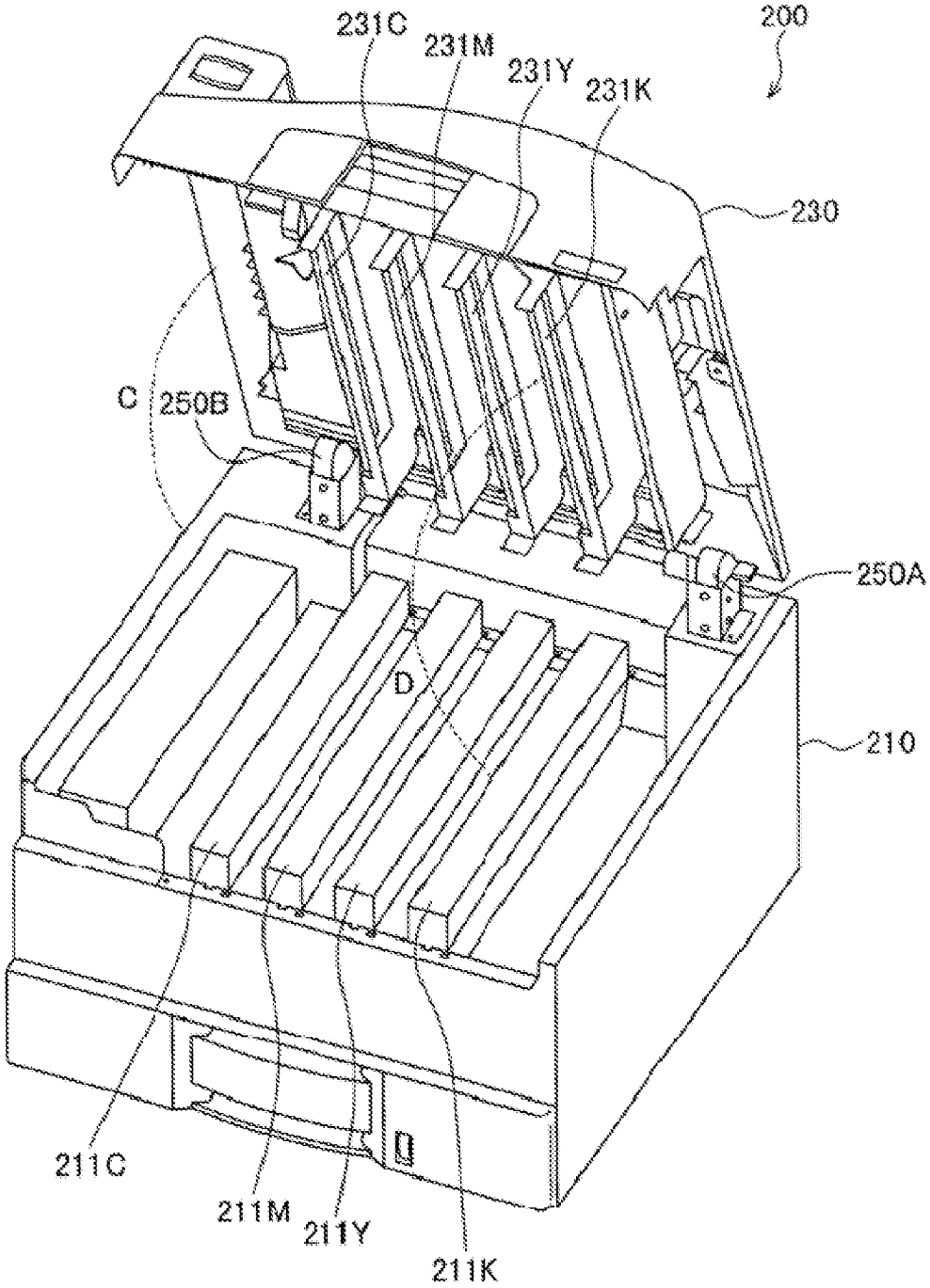
FIG. 13 is a diagram of a general configuration of an image forming apparatus according to a second embodiment.

Next, the second embodiment of the invention will be described. FIG. 13 is a diagram of the general configuration of image forming apparatus 200 according to the second embodiment of the invention. As shown in the figure, image forming apparatus 200 includes apparatus body 210 and cover 230, wherein the direction of opening and closing cover 230 with respect to the apparatus body 210 is different from that of the first embodiment. Such differences from the first embodiment will be mainly described in the following description.

Apparatus body 210 accommodates therein image forming units 211K, 211Y, 211M, and 211C. Image forming unit 211K is for black, image forming unit 211Y is for yellow, image forming unit 211M is for magenta, and image forming unit 211C is for cyan. Those image forming units are referred to as image forming unit 211 in the following description when they do not need to be distinguished from one another. Note that the configuration of image forming unit 211 has the same configuration as that of the first embodiment except for side frame 218B shown in FIG. 14 and side frame 218A (not shown in FIG. 14) which has the same structure as side frame 218B.

Exposure devices 231K, 231Y, 231M, and 231C are attached to and accommodated in cover 230. Exposure device 231K is configured for black, exposure device 231Y is for yellow, exposure device 231M is for magenta, and exposure device 231C is for cyan, and those exposure devices are referred to as exposure device 231 in the following description when they do not need to be distinguished from one another.

Cover 230 is attached to apparatus body 210 with axis members 250A and 250B so that cover 230 rotates about the rotational axis of axis members 250A and 250B between a first position where cover 230 closes an upper opening of apparatus body 210 and a second position where cover 230 opens the upper opening of apparatus body 210. When closing and opening cover 230, cover 230 rotationally moves along circular arc path C about the rotational axis of axis members 250A and 250B, and thus exposure device 231, which is attached to and accommodated in cover 230, moves along circular arc path D corresponding to the movement (circular arc path C) of cover 230. Note that although cover 130 opens and closes with respect to apparatus body 110 in such a manner that the rotational axis of cover 130 is parallel to the axis of photosensitive drum 112 in the first embodiment; cover 230 opens and closes with respect to apparatus body 210 in such a manner that the rotational axis of cover 230 is orthogonal to the axis of photosensitive drum 112 in the second embodiment.

Figure 14:
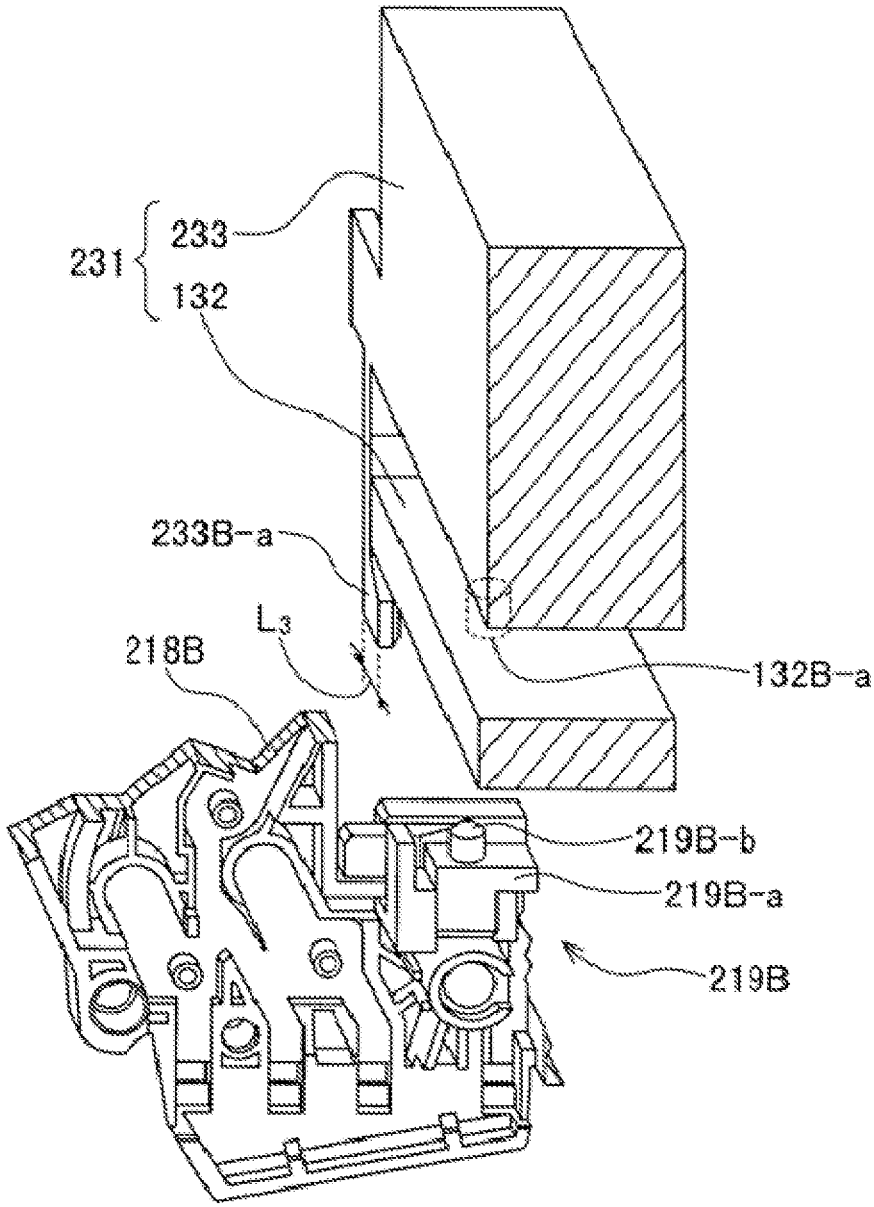
FIG. 14 is a diagrammatic view illustrating an exposure device and a side frame according to the second embodiment.

FIG. 14 is a diagrammatic view illustrating exposure device 231 and side frame 218B. Like the first embodiment, side frame 218A (not shown) and side frame 218B are provided at the longitudinal ends of the photosensitive drum (not shown), respectively, and rotatably support the photosensitive drum.

As shown in FIG. 14, side frame 218B is provided with adjustment unit 219B. Adjustment unit 219B has post 219B-b, serving as a positioning projection, projecting toward exposure device 231. Note that adjustment unit 219B will be described later in detail with reference to FIG. 15.

Exposure device 231 includes exposure head 132 and exposure head holder 233, which is different from exposure head holder 133 of the first embodiment. Next, exposure head holder 233 will be described.

A widthwise end of exposure head holder 233 is fixed on the inside surface of cover 230, which faces apparatus body 210. Exposure head holder 233 has tab 233B-a, which is different from tab 133B-a of the first embodiment and will be described in detail. Note that tab 233A-a, which is provided at the opposite side of tab 233B-a, has mirror symmetry image of tab 233B-a with respect to a plane orthogonal to the longitudinal direction of exposure head holder 233.

In the second embodiment, tab 233B-a is formed at a longitudinal end of exposure head holder 233, extending downward from exposure head holder 233. Note that tab 233B-a has its length L3 which extends from the outer lateral side into the inner lateral side of side frame 218B. A part of tab 233B-a that extends inward from side frame 218B will come in contact with second inclined surface 219B-i of intervening member 219B-d (to be described later) when cover 230 moves toward apparatus body 210 upon closing cover 230.

Note that the shape and size of tab 233B-a is designed in such a manner that the tip of tab 233B-a comes in contact with second inclined surface 219B-i of intervening member 219B-d (to be described later) when the tip of post 219B-b of adjustment unit 219B is inserted into positioning hole 132B-a formed at exposure head 132.

Figure 15:
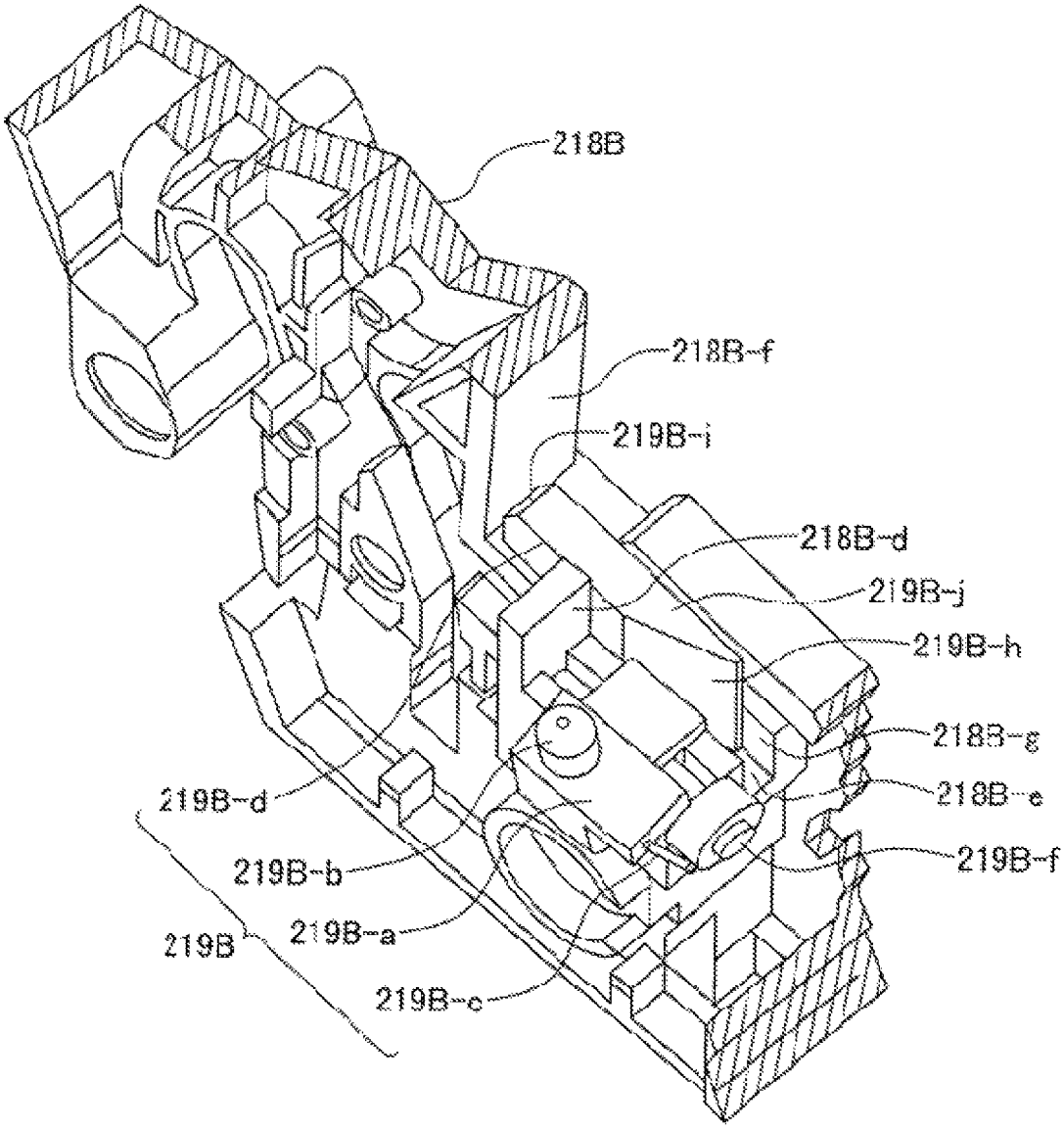
FIG. 15 is a perspective view illustrating an adjustment unit and the side frame according to the second embodiment.

FIG. 15 is a perspective view illustrating adjustment unit 219B and side frame 218B. As shown in FIG. 5, adjustment unit 219B includes adjustment unit base member 219B-a, post 219B-b, bias member 219B-c, and intervening member 219B-d.

Adjustment unit base member 219B-a is configured to be rotatable with respect to side frame 218B about its rotational axis parallel to the rotational axis of cover 230.

For example, in the second embodiment, first wall 218B-d, extending substantially orthogonal to the rotational axis of cover 230, is formed at the inner lateral surface of side frame 218B. A surface of first wall 218B-d, which faces adjustment unit 219B, has an unillustrated bearing hole whose axis is parallel to the rotational axis of cover 230. Adjustment unit base member 219B-a is formed with an unillustrated through hole. Adjustment unit base member 219B-a is disposed at the inner lateral side of side frame 218B in such a manner that the unillustrated through hole of adjustment unit base member 219B-a is aligned with the unillustrated bearing hole of first wall 218B-d of side frame 218B. From the opposite side of the first wall 218B-d across side frame 218B, axis member 219B-f is inserted through the unillustrated through hole of adjustment unit base member 219B-a and the end of axis member 219B-f is inserted in the unillustrated bearing hole of first wall 218B-d. With this, adjustment unit base member 219B-a is rotatable about the axis of axis member 219B-f.

Post 219B-b projects upward from adjustment unit base member 219B-a, that is, in a direction toward cover 230. The projecting direction of post 219B-b is orthogonal to the rotational axis of adjustment unit base member 219B-a. The shape and size of post 219B-b is designed in such a manner that post 219B-d is fit in positioning hole 132B-a formed at exposure head 132. Note that the end of post 219B-b is formed in a tapered shape whose cross-section gradually decreases from a certain point toward the end of post 219B-b, in order to prevent post 219B-b from getting stuck on the edge of positioning hole 132B-a and exposure head 132 disposed around positioning hole 132B-a when inserting post 219B-b into positioning hole 132B-a.

Bias member 219B-c is, for example, a torsion spring. One end of bias member 219B-c is fixed to the upper portion of adjustment unit base member 219B-a while the other end of bias member 219B-c is fixed to side frame 218B, so that bias member 219B-c biases the upper portion of adjustment unit base member 219B-a toward axis members 250A and 250B of cover 230. Note that the upper portion of adjustment unit base member 219B-a is a portion of adjustment unit base member 219B-a closer to post 219B-b than the unillustrated through hole, that is, a portion of adjustment unit base member 219B-a higher than the unillustrated through hole.

When exposure device 231 gets closer to side frame 218B upon closing cover 230, intervening member 219B-d pushes the lower portion of adjustment unit base member 219B-a toward axis members 250A and 250B of cover 230 against the biasing force of bias member 219B-c. Note that the lower portion of adjustment unit base member 219B-a is a portion of adjustment unit base member 219B-a lower than the axis of the unillustrated through hole, that is, a portion of adjustment unit base member 219B-a on the opposite side of post 219B-b with respect to the axis of the unillustrated through hole.

Figure 16A:
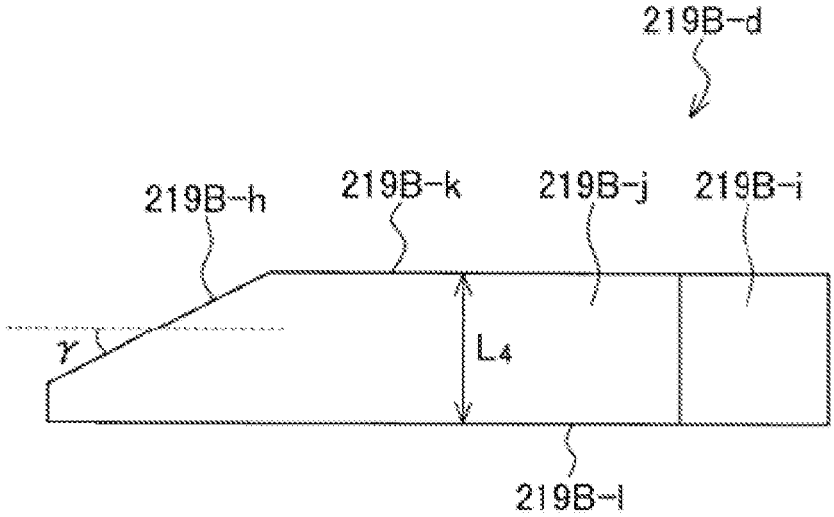
FIG. 16A is a top view and FIG. 16B is a side view of an intervening member according to the second embodiment.
Figure 16B:
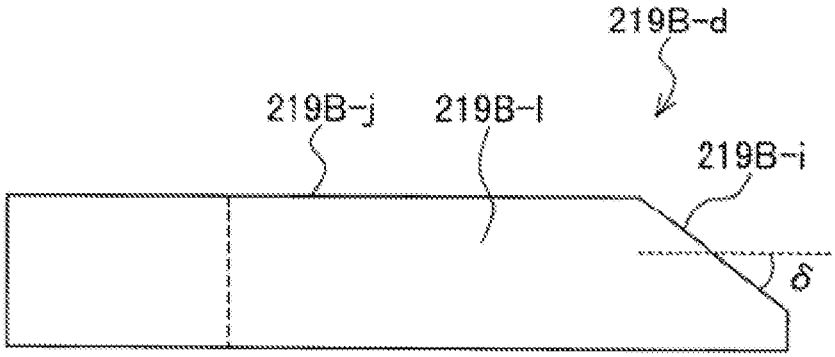

For example, as shown in FIGS. 16A and 16B, intervening member 219B-d is a column member extending in a direction and has first inclined surface 219B-h at a first longitudinal end (see FIG. 16A, the top view of intervening member 219B-d)

and has second inclined surface 219B-i at a second longitudinal end (see FIG. 16B, the side view of intervening member 219E-d).

As shown in FIG. 16A, first inclined surface 219B-h is formed on side surface 219B-k of intervening member 219B-d in such a manner that the thickness of the first longitudinal end portion of intervening member 219B-d gradually expands from the first longitudinal end toward the second longitudinal end. As shown in FIG. 15, when intervening member 219B-d is disposed in a slide guide space defined by second wall 218B-f, third wall 218B-g, and bottom wall 218B-e of side frame 218B, upper surface 219B-j faces upward and first inclined surface 219B-h faces adjustment unit base member 219B-a.

As shown in FIG. 16B, second inclined surface 219B-i is formed on upper surface 219B-j of intervening member 219B-d in such a manner that the thickness of the second longitudinal end portion of intervening member 219B-d gradually expands from the second longitudinal end toward the first longitudinal end. Note that side surface 219B-1 of intervening member 219B-d, which is the opposite side of side surface 219B-k having first inclined surface 219B-h, is a flat surface.

Note that angle δ of first inclined surface 219B-h with respect to the longitudinal direction of intervening member 219B-d and angle σ of second inclined surface 219B-i with respect to the longitudinal direction of intervening member 219B-d are designed so as to change the inclination of adjustment unit base member 219B-a to homologize the reference line of post 219B-b to the reference line of positioning hole 232B-a when post 219B-b of adjustment unit base member 219B-a goes into positioning hole 232B-a formed at exposure head 232 upon closing of cover 230.

Referring back to FIG. 15, side frame 218B includes bottom wall 218B-e, second wall 218B-f, and third wall 218B-g.

Bottom wall 218B-e is formed on the side frame 218B at the side where adjustment unit 219B is located and formed at a portion of side frame 218B lower than the axis of the unillustrated bearing hole of first wall 218B-d of side frame 218B. An upper face of bottom wall 218B-e is a smooth flat surface on which intervening member 219B-d can be placed.

Second wall 218B-f is erected upright from bottom wall 218B-e and has a surface orthogonal to the axis of the unillustrated through hole of adjustment unit base member 219B-a. Second wall 218B-f is designed at a position such that when the second longitudinal end having second inclined surface 219B-i of intervening member 219B-d, which is placed on bottom wall 218B-e, comes in contact with second wall 218B-f, first inclined surface 219B-h of intervening member 219B-d faces adjustment unit base member 219B-a with a gap between intervening member 219B-d and adjustment unit base member 219B-a and thus post 219B-b formed at adjustment unit base member 219B-a is biased and inclined toward axis members 250A and 250B of cover 230 due to the biasing force of bias member 219B-c.

Third wall 218B-g is erected upright from bottom wall 218B-e and has a surface opposed to adjustment unit base member 219B-a. A gap between third wall 218B-g and adjustment unit base member 219B-a is the same as or slightly greater than distance L4 (see FIG. 16A) between side surface 219B-k and side surface 219B-1.

Note that when intervening member 219B-d is placed in the space defined by adjustment unit base member 219B-a, bottom wall 218B-e, second wall 218B-f, and third wall 218B-g, intervening member 219*b-d* is in contact with adjustment unit base member 219B-a at a position lower than the axis of the unillustrated through hole of adjustment unit base member 219B-a.

Note that side frame 218A has mirror symmetry image of side frame 218B and adjustment unit 219A has a mirror symmetry image of adjustment unit 219B, with respect to a plane orthogonal to the rotational axis of the photosensitive drum (not shown).

Figure 17:
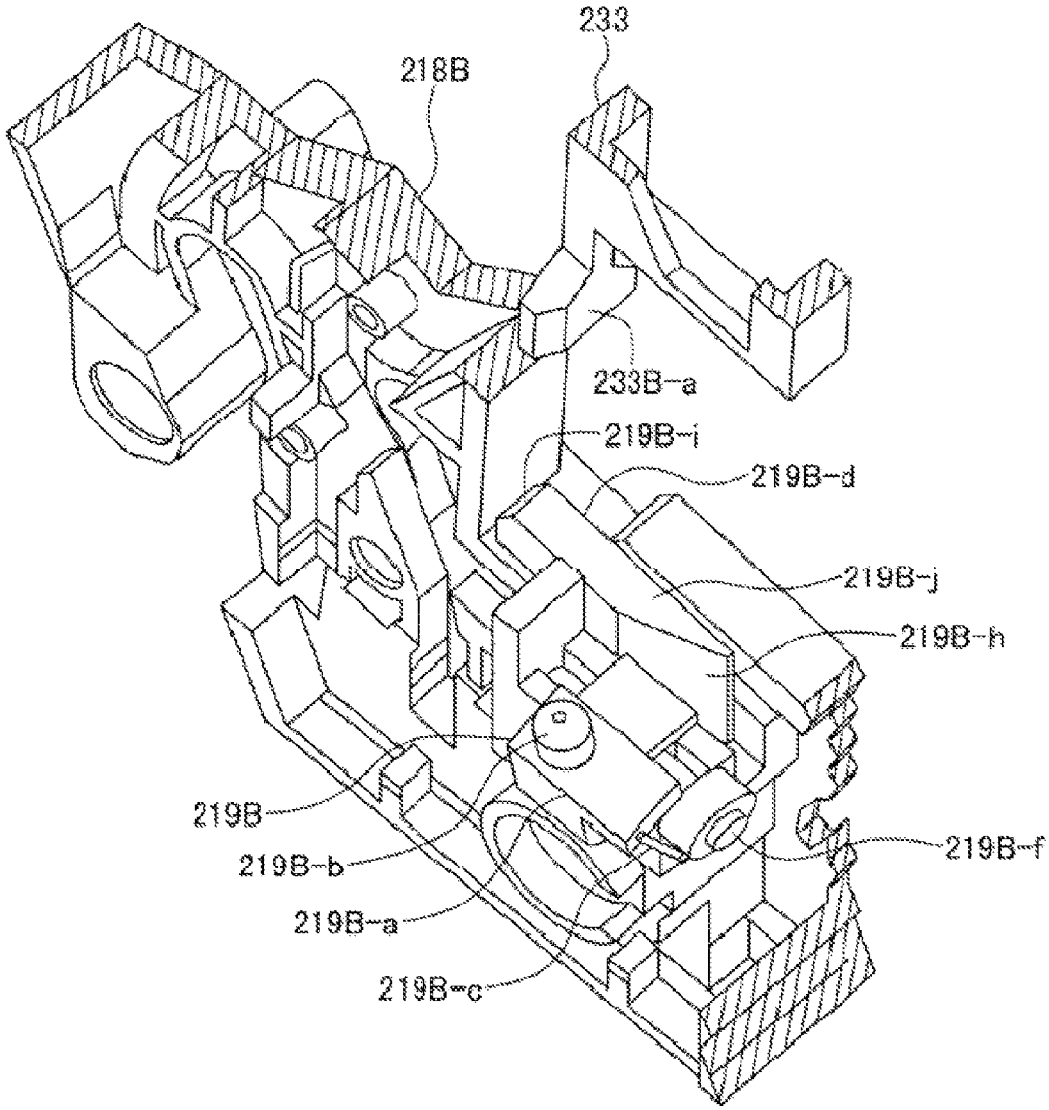
FIG. 17 is a diagrammatic view illustrating the orientation (inclination) of a post when the exposure device and the side frame are apart from each other according to the second embodiment.

As described above, the second embodiment has tab 233B- and adjustment unit 219B. Accordingly, in the state where exposure head holder 233 is away from side frame 218B and tab 233B-a is thus not in contact with intervening member 219B-d of adjustment unit 219B as shown in FIG. 17, the lower portion of adjustment unit base member 219B-a, which is a portion of adjustment unit base member 219B-a on the opposite side of post 219B-b with respect to the axis of axis member 219B-f, is biased away from axis members 250A and 250B of cover 230 by the biasing force of bias member 219B-c. Thus, post 219B-b inclines such that the tip of post 219B-b orients toward axis members 250A and 250B of cover 230 (see FIG. 13).

Figure 18:
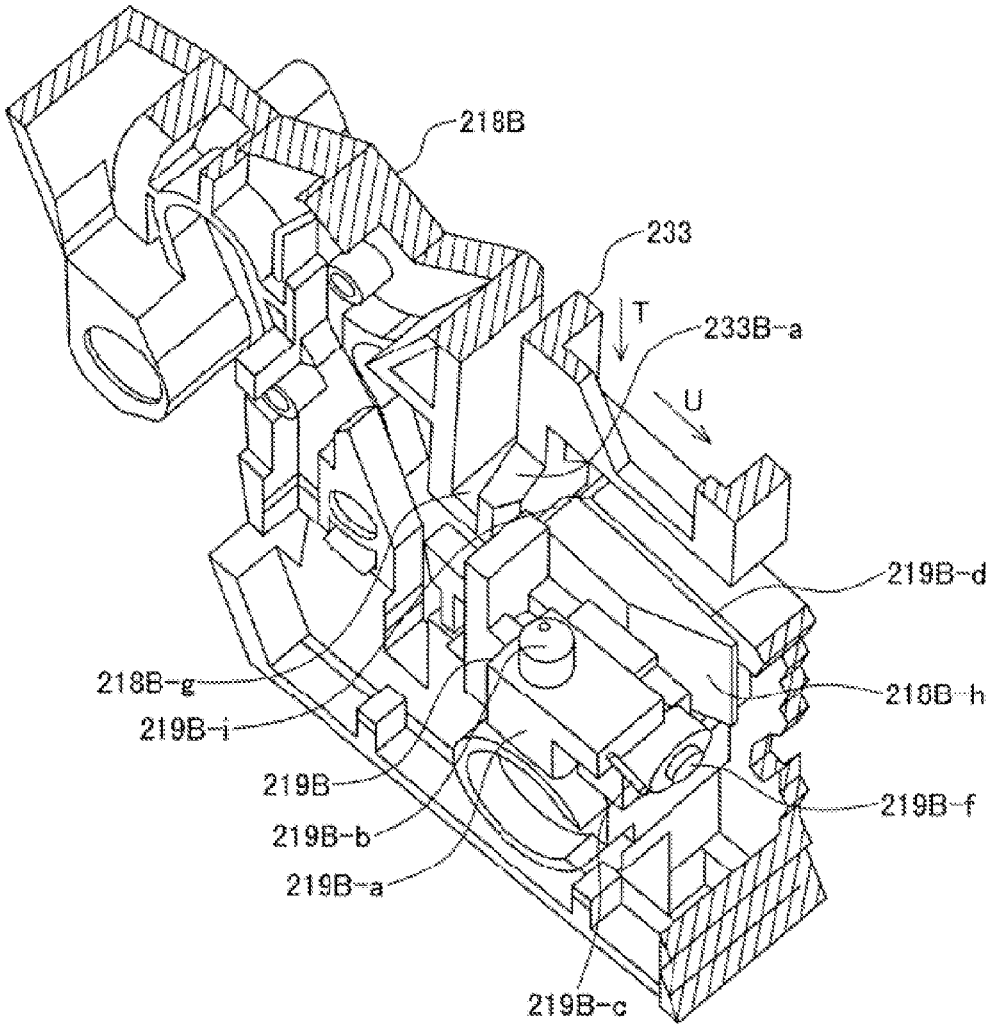
FIG. 18 is a diagrammatic view illustrating the orientation of the post (inclination) when the exposure device and the side frame are close to each other according to the second embodiment.

On the other hand, in the state where exposure head holder 233 gets closer to side frame 218B and thus tab 233B-a comes in contact with bottom wall 218B-e of side frame 218B as shown in FIG. 18, tab 233B-a contacts with second inclined surface 219B-i of intervening member 219B-d and thus a downward force (in direction T) from tab 233B-a is received and converted by second inclined surface 219B-i to push intervening member 219B-d in direction U. When intervening member 219B-d moves in direction U, the distance between intervening member 219B-d and adjustment unit base member 219B-a becomes smaller due to first inclined surface 219B-h. Thus, the lower portion of adjustment unit base member 219B-a, which is a portion of adjustment unit base member 219B-a on the opposite side of post 219B-b with respect to the axis of axis member 219B-f, is pushed toward axis members 250A and 250B of cover 230 (see FIG. 13) against the biasing force of bias member 219B-c. Thus, the tip of post 219B-b moves away from axis members 250A and 250B of cover 230, and finally post 219B-b orients substantially upright.

As shown in FIGS. 17 and 18, in the second embodiment, due to the movement of exposure device 231 upon closing and opening cover 230 (see FIG. 13), posts 219A-b and 219B-b of adjustment units 219A and 219B move between a first position closer to axis members 250A and 250B of cover 230 and a second position away from axis members 250A and 250B of cover 230.

According to the configuration of the second embodiment as described above, as shown in FIG. 19A, in the state where exposure head 232 is not in contact with intervening member 219B-d of adjustment unit 219B, reference line G of post 219B-b inclines toward axis members 250A and 250B of cover 230 (see FIG. 13) due to the biasing force of bias member 219B-c.

Figures 19A, 19B, 19C, 19D:
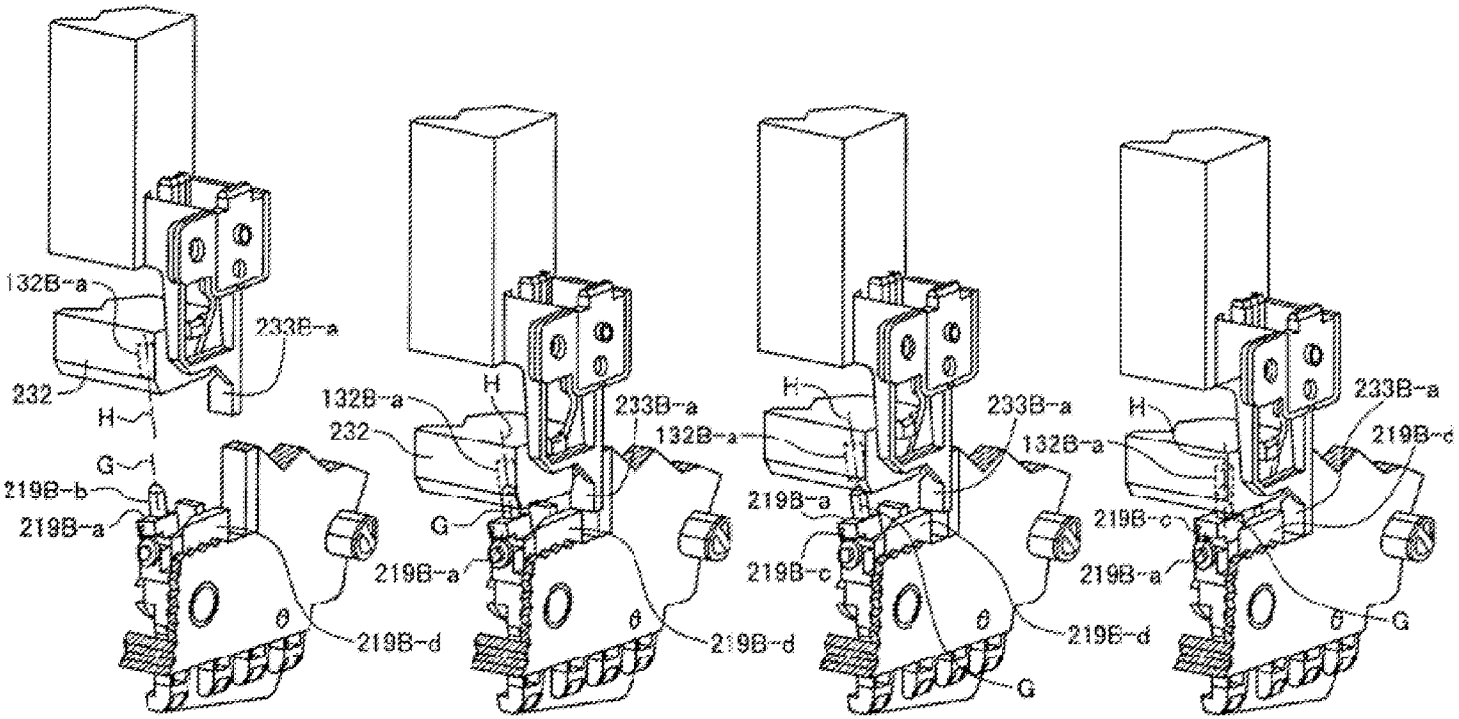
FIGS. 19A to 19D are diagrammatic views illustrating change of the orientation (inclination) of the post with respect to a positioning hole according to the second embodiment.

As shown in FIG. 19B, when tab 233B-a starts contacting second inclined surface 219B-i (see FIG. 16B) of intervening member 219B-d after cover 230 (see FIG. 13) is further closed from the position shown in FIG. 19A, the inclination of reference line G of post 219B-b of adjustment unit base member 219B-a is designed such that reference line G of post 219B-b is aligned with reference line H of positioning hole 132B-a.

As shown in FIG. 19C, when cover 230 (see FIG. 13) is further closed from the position shown in FIG. 19B, tab 233B-a pushes second inclined surface 219B-i (see FIG. 16B) of intervening member 219B-d, thereby moving intervening member 219B-d toward adjustment unit 219B. Thus, first inclined surface 219B-h (see FIG. 16A) of intervening member 219B-d pushes adjustment unit base member 219B-a toward axis members 250A and 250B of cover 230 (see FIG. 13) against the biasing force of bias member 219B-c. Accordingly, the angle of the inclination of reference line G of post 219B-b becomes smaller such that reference line G of post 219B-b rotates toward side frame 218B away from axis members 250A and 250B of cover 230 (see FIG. 13) toward side frame 218B. Therefore, the inclination of reference line G of post 219B-b is changed in accordance with the change of the inclination of reference line H of positioning hole 132B-a formed at exposure head 232, which rotates about the rotational axis of axis members 250A and 250B of cover 230 (see FIG. 13), thereby aligning such reference lines G and H (or the extensions of reference lines G and H) to each other.

Further, as shown in FIG. 19D, when tab 233B-a reaches the position where tab 233B-a comes in contact with bottom wall 218B-e of side frame 218B by further closing cover 230 (see FIG. 13) from the position of FIG. 19C, first inclined surface 219B-h (see FIG. 16A) of intervening member 219B-d further pushes adjustment unit base member 219B-a toward axis members 250A and 250B of cover 230 (see FIG. 13). Thus, reference line G of post 219B-b rotates further away from axis members 250A and 250B of cover 230 and orients in substantially the vertical direction. Accordingly, the inclination of reference line G of post 219B-b is changed in accordance with the change of the inclination of reference line H of positioning hole 132B-a formed at exposure head 232, which rotates about the rotational axis of axis members 250A and 250B of cover 230 (see FIG. 13), resulting in aligning the inclination of reference lines G and H to each other. Note that "the reference lines are aligned to each other" in this embodiment means that a shifted amount between reference lines is less than a predetermined threshold. Such threshold is a value that prevents out of focus due to variation of the distance between exposure device 131 and photosensitive drum 112 where exposure head 232 and image forming unit 111 are aligned to each other.

According to the second embodiment as described above, the inclination of the reference lines of posts 219A-b and 219B-b formed at side frames 218A and 218B are changed in accordance with the change of the inclination of the reference lines of positioning holes 132A-a and 132B-a formed at exposure device 231 with the movement of exposure device 231 along the circular arc path. Therefore, posts 219A-b and 219B-b are able to be inserted into positioning holes 232A-a and 232B-a without being stuck on the peripheries of positioning holes 232A-a and 232B-a. Since the second embodiment has such a mechanism, exposure device 231 and the photosensitive drum (not shown), which are aligned to each other by inserting posts 219A-b and 219B-b into positioning holes 132A-a and 132B-a, are reliably positioned to have a predetermined distance between exposure device 231 and the photosensitive drum. This prevents variation of the distance between exposure device 231 and the photosensitive drum, resulting in preventing out of focus.

Figure 20:
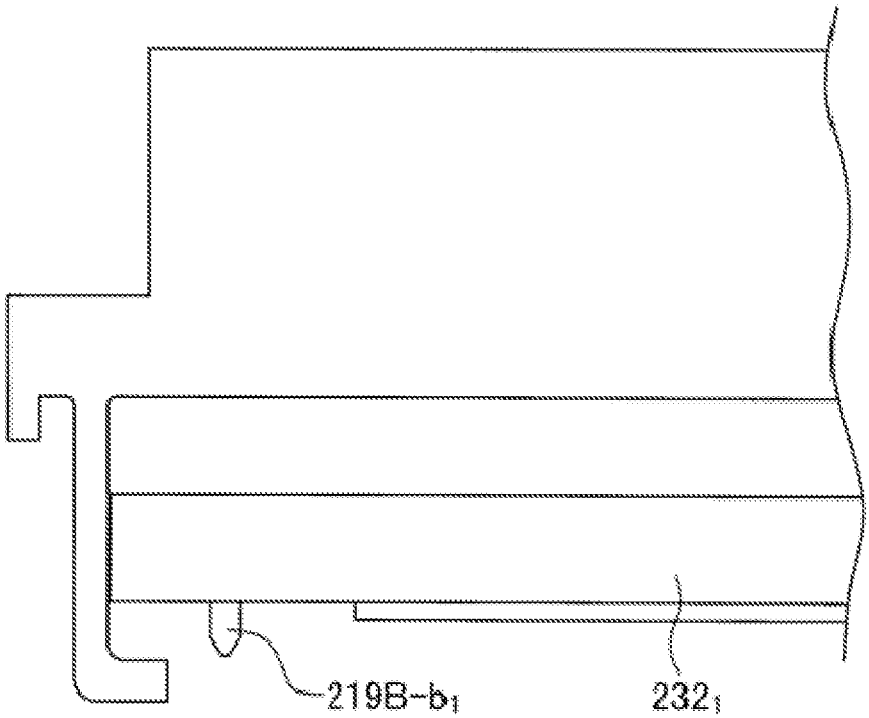
FIG. 20 is a side view of a modification of the second embodiment.
Figure 20:
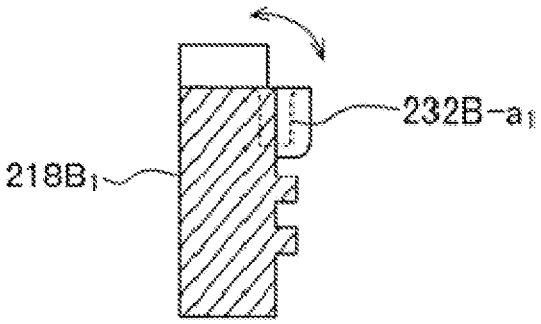

Although positioning holes 132A-a and 132B-a are provided at exposure head 232 and posts 219A-b and 219B-b are provided at side frames 218A and 218B in the second embodiment, the invention is not limited to this. For example, as shown in FIG. 20 (a first modification of the second embodiment), post 219B-$b_1$ may be provided at exposure head 232$_1$ and positioning hole 232B-$a_1$ may be provided at side frame 218B$_1$.

Figure 21:
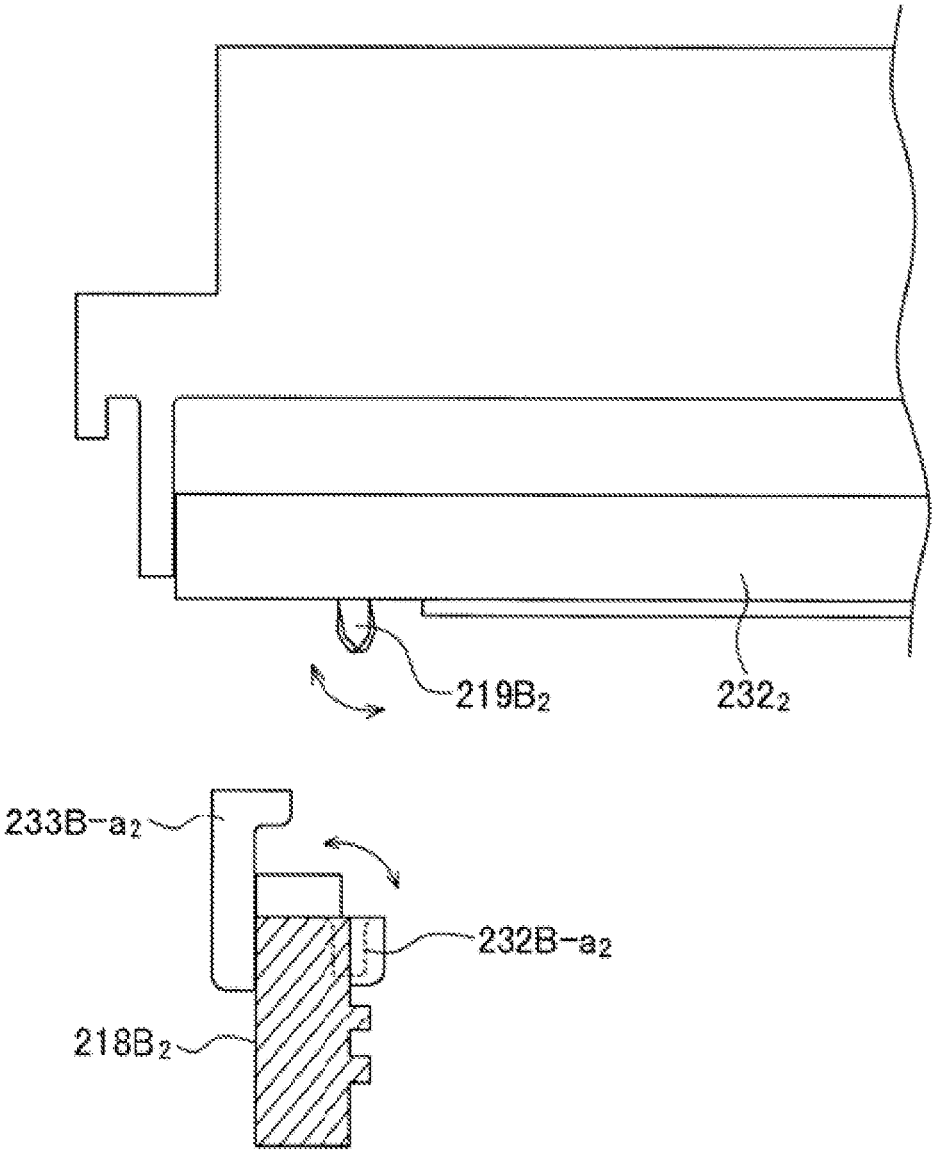
FIG. 21 is a side view of a modification of the second embodiment.

Although adjustment units 219A and 219B formed at side frames 218A and 218B rotate with respect to side frames 218A and 218B so as to change the inclination of posts 219A-b and 219B-b in the second embodiment, the invention is not limited to this. For example, as shown in FIG. 21 (a second modification of the second embodiment), adjustment unit 219B$_2$ may be provided at exposure head 232$_2$ and tab 233B-$a_2$ and positioning hole 232B-$a_2$ may be provided at side frame 218B$_2$.

Figure 22:
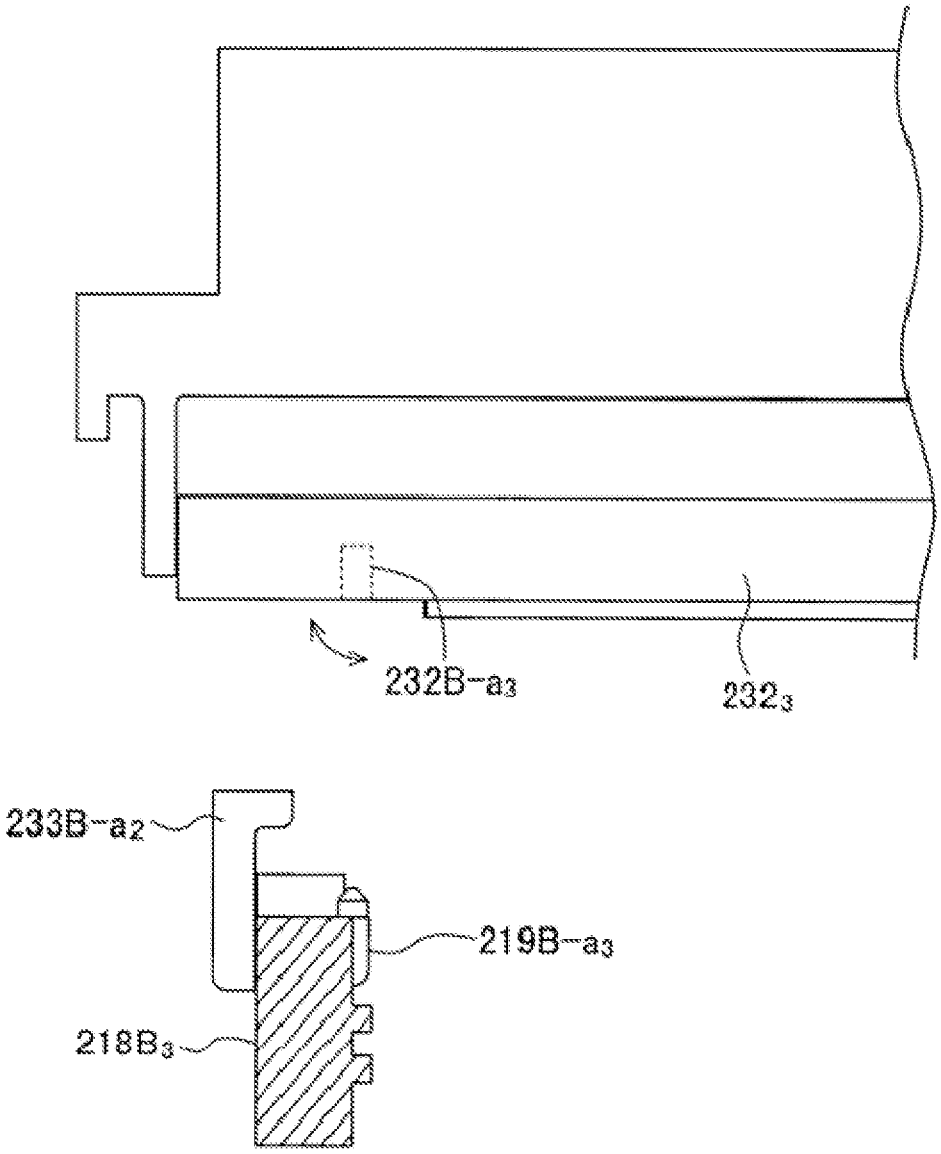
FIG. 22 is a side view of a modification of the second embodiment.

Further, the post and the positioning hole shown in FIG. 22 may be replaced with each other, that is, positioning hole 232B-$a_3$ may be provided at exposure head 232$_3$ and post 219B-$b_3$ may be provided at side frame 218B$_3$ as shown in FIG. 22 (a third modification of the second embodiment).

The invention can be applied to any image forming apparatus, such as a copy machine, a print machine, a facsimile machine, or an MFP (Multifunction Peripheral), comprising the apparatus body equipped with an image forming unit and a cover configured to open and close the apparatus body and equipped with an exposure head, wherein the exposure head and the image forming unit are positioned to each other when the cover is closed.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus, comprising:

an apparatus body formed with an opening;

a cover capable of opening and closing the opening of the apparatus body;

an image forming unit accommodated in the apparatus body;

an exposure device provided at the cover;

a first fit part provided at one of the image forming unit and the exposure device and having a first reference line;

a second fit part provided at the other of the image forming unit and the exposure device and configured to be fit to the first fit part in a state where the cover is closed and having a second reference line; and a mechanism configured to, as the exposure device approaches closer to the image forming unit upon closing the cover, make the first reference line of the first fit part closer to the second reference line of the second fit part by changing the inclination of the first fit part, wherein the mechanism includes:

a contact part formed at the other;

a base member rotatably attached to the one and formed with the first fit part; and a bias member configured to bias the base member to rotate in a first rotational direction; and an intervening member configured to be pushed by the contact part and to push the base member to rotate in a second rotational direction opposite to the first rotational direction, against the bias member, as the exposure device gets closer to the image forming unit.

2. The image forming unit according to claim 1, wherein the first reference line and the second reference line are aligned to each other in the state where the first fit part is fit to the second fit part.

3. The image forming apparatus according to claim 1, wherein the intervening member includes a first inclined surface at one longitudinal end of the intervening member and a second inclined surface at the other longitudinal end of the intervening member, and the intervening member is provided between the one and the base member and is movable in the longitudinal direction of the intervening member with respect to the one.

4. The image forming apparatus according to claim 3, wherein as the exposure device gets closer to the image forming unit upon closing the cover, the contact part moves the intervening member in the longitudinal direction of the intervening member by pushing the second inclined surface of the intervening member and thus the first inclined surface, which forms a thickness variation of the intervening member between the one and the base member, pushes the base member to rotate in the second rotational direction against the bias member.

5. The image forming apparatus according to claim 1, wherein the cover is rotatable about a first rotational axis with respect to the apparatus body such that the cover opens and closes the opening of the apparatus body, and a second rotational axis of the base member is parallel to the first rotational axis of the cover.

6. The image forming apparatus according to claim 1, wherein the first reference line and the second reference line are respectively imaginary lines in the extending directions of the ends of the first fit part and the second fit part.

7. The image forming apparatus according to claim 1, wherein the first fit part is a projection and the second fit part is a recess into which the first fit part is fit.

8. The image forming apparatus according to claim 1, wherein the second fit part is a projection and the first fit part is a recess into which the second fit part is fit.

9. The image forming apparatus according to claim 1, wherein the first fit part is provided at the image forming unit and the second fit part is provided at the exposure device.

10. The image forming apparatus according to claim 1, wherein the second fit part is provided at the image forming unit and the first fit part is provided at the exposure device.

11. An image forming unit capable of being used for an image forming apparatus, the image forming apparatus comprising an apparatus body, a cover capable of opening or closing an opening of the apparatus body, an exposure device attached to the cover, a second fit part provided at the exposure device, and the image forming unit accommodated in the apparatus body, the image forming unit comprising:

an image carrier;

a support configured to support the image carrier to be rotatable;

a first fit part provided at the support and configured to fit to the second fit part in a state where the cover is closed with respect to the apparatus body;

a mechanism configured to, as the exposure device approaches closer to the image forming unit upon closing the cover, make a first reference line of the first fit part closer to a second reference line of the second fit part by changing the inclination of the first fit part, wherein the mechanism includes:

a base member rotatable with respect to the image forming unit and formed with the first fit part;

a bias member configured to bias the base member to rotate in a first rotational direction; and an intervening member configured to be pushed by a contact part formed at the exposure device, pushing the base member to rotate in a second rotational direction opposite to the first rotational direction, against the bias member, as the exposure device gets closer to the image forming unit.

12. The image forming unit according to claim 11, wherein the first reference line and the second reference line are aligned to each other in the state where the first fit part is fit to the second fit part.

13. The image forming unit according to claim 11, wherein the intervening member includes a first inclined surface at one longitudinal end of the intervening member and a second inclined surface at the other longitudinal end of the intervening member, the intervening member is provided between the image forming unit and the base member and is movable in the longitudinal direction of the intervening member with respect to the image forming unit.

14. The image forming unit according to claim 11, wherein as the exposure device gets closer to the image forming unit upon closing the cover, the contact part moves the intervening member in the longitudinal direction of the intervening member by pushing the second inclined surface of the intervening member and thus the first inclined surface, which forms a thickness variation of the intervening member between the image forming unit and the base member, pushes the base member to rotate in the second rotational direction against the bias member.

15. The image forming unit according to claim 11, wherein the cover is rotatable about a first rotational axis with respect to the apparatus body such that the cover opens and closes the opening of the apparatus body, and a second rotational axis of the base member is parallel to the first rotational axis of the cover.

16. The image forming unit according to claim 11, wherein one of the first fit part and the second fit part is a projection while the other of the first fit part and the second fit part is a recess.

* * * * *